US010081900B2

(12) United States Patent
Wells et al.

(10) Patent No.: US 10,081,900 B2
(45) Date of Patent: Sep. 25, 2018

(54) CLEANING METHOD INCLUDING USE OF SOLID PARTICLES

(71) Applicant: Xeros Limited, Rotherham, South Yorkshire (GB)

(72) Inventors: Simon Paul Wells, Rotherham (GB); Michael Sawford, Rotherham (GB); Wayne Robert Szymczyk, Rotherham (GB); Elizabeth Jean Abercrombie, Rotherham (GB); Stephen Derek Jenkins, Rotherham (GB)

(73) Assignee: Xeros Limited, Rotherham (GB)

( * ) Notice: Subject to any disclaimer, the term of this patent is extended or adjusted under 35 U.S.C. 154(b) by 617 days.

(21) Appl. No.: 14/537,314

(22) Filed: Nov. 10, 2014

(65) Prior Publication Data

US 2015/0128358 A1 May 14, 2015

(30) Foreign Application Priority Data

Nov. 8, 2013 (GB) ..... 1319782.7

(51) Int. Cl.
*D06F 33/02* (2006.01)
*D06F 35/00* (2006.01)
(Continued)

(52) U.S. Cl.
CPC ..... *D06F 35/005* (2013.01); *D06F 33/02* (2013.01); *D06F 35/006* (2013.01); *D06F 39/026* (2013.01); *D06F 39/088* (2013.01)

(58) Field of Classification Search
None
See application file for complete search history.

(56) References Cited

U.S. PATENT DOCUMENTS 2,970,464 A 2/1961 Toma
3,321,843 A 5/1967 Taran et al.
(Continued)

FOREIGN PATENT DOCUMENTS

CA 1284407 C 5/1991
CN 2789299 Y 6/2006
(Continued)

OTHER PUBLICATIONS

U.S. Appl. No. 15/344,120, He et al.
(Continued)

*Primary Examiner* — Rita P Adhlakha
(74) *Attorney, Agent, or Firm* — Clark & Elbing LLP

(57) ABSTRACT

Methods for cleaning at least one soiled substrate in a rotatably mounted cylindrical drum of a cleaning apparatus with a multiplicity of solid particles are provided. One method includes the steps of: agitating the at least one soiled substrate in the drum with wash liquor and the multiplicity of solid particles for a first cleaning cycle wherein the wash liquor includes at least one cleaning agent; draining the wash liquor from the cleaning apparatus; and introducing an aqueous non-detergent medium into the cleaning apparatus and agitating the at least one soiled substrate with the multiplicity of solid particles in the drum for a second cleaning cycle. Another method includes rotating the drum such that the at least one soiled substrate moves about a generally circular path and introducing the multiplicity of solid particles into the drum through an annulus defined by the generally circular path as the drum rotates.

11 Claims, 2 Drawing Sheets

(51) Int. Cl.
*D06F 39/02* (2006.01)
*D06F 39/08* (2006.01)

(56) References Cited

U.S. PATENT DOCUMENTS

| | | | |
|---|---|---|---|
| 3,333,344 | A | 8/1967 | Loewen |
| 3,647,354 | A | 3/1972 | Loeb |
| 3,650,673 | A | 3/1972 | Ehner |
| 3,805,406 | A | 4/1974 | Castonoli |
| 4,055,248 | A | 10/1977 | Marsan |
| 4,130,392 | A | 12/1978 | Diehl et al. |
| 4,188,807 | A | 2/1980 | Graf et al. |
| 4,326,971 | A | 4/1982 | Wixon |
| 4,374,443 | A | 2/1983 | Mosell |
| 4,434,067 | A | 2/1984 | Malone et al. |
| 4,493,783 | A | 1/1985 | Su et al. |
| 4,575,887 | A | 3/1986 | Viramontes |
| 4,637,890 | A | 1/1987 | Crabtree et al. |
| 4,655,952 | A | 4/1987 | Mesmer et al. |
| 4,750,227 | A | 6/1988 | Hopkins et al. |
| 4,801,333 | A | 1/1989 | Mosell |
| 4,809,854 | A | 3/1989 | Tomaszek |
| 4,839,969 | A | 6/1989 | Hahn |
| 4,951,366 | A | 8/1990 | Geller |
| 4,978,619 | A | 12/1990 | Kajiwara et al. |
| 5,245,722 | A | 9/1993 | Dameron |
| 5,305,533 | A | 4/1994 | Alexander et al. |
| 5,324,649 | A | 6/1994 | Arnold et al. |
| 5,367,734 | A | 11/1994 | Terry |
| 5,468,175 | A | 11/1995 | Nilen |
| 5,475,992 | A | 12/1995 | Wiegert |
| 5,503,840 | A | 4/1996 | Jacobson et al. |
| 5,547,476 | A | 8/1996 | Siklosi et al. |
| 5,601,480 | A | 2/1997 | Nilen |
| 5,605,491 | A | 2/1997 | Yam et al. |
| 5,667,431 | A | 9/1997 | Mortin |
| 5,804,548 | A | 9/1998 | Davis |
| 5,849,684 | A | 12/1998 | Donoghue et al. |
| 5,925,195 | A | 7/1999 | King et al. |
| 5,978,994 | A | 11/1999 | Anderson |
| 5,980,620 | A | 11/1999 | Brodie et al. |
| 5,993,839 | A | 11/1999 | Mixon |
| 6,235,705 | B1 | 5/2001 | Zembrodt et al. |
| 6,348,441 | B1 | 2/2002 | Aiken, III et al. |
| 6,376,046 | B1 | 4/2002 | Hoshino et al. |
| 6,448,212 | B1 | 9/2002 | Holderbaum et al. |
| 6,764,992 | B2 | 7/2004 | Kumar et al. |
| 7,015,156 | B2 | 3/2006 | Maldonado et al. |
| 7,070,489 | B2 | 7/2006 | Rogmark |
| 7,097,715 | B1 | 8/2006 | Racette et al. |
| 7,481,893 | B2 | 1/2009 | Motson et al. |
| 7,498,294 | B2 | 3/2009 | Konno et al. |
| 7,700,539 | B2 | 4/2010 | Muller et al. |
| 8,490,440 | B2 | 7/2013 | Aykroyd et al. |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 2001/0031714 | A1 | 10/2001 | Gassenmeier et al. |
| 2002/0010300 | A1 | 1/2002 | Mimoun |
| 2002/0016282 | A1 | 2/2002 | Kumar et al. |
| 2002/0022050 | A1 | 2/2002 | Anderson et al. |
| 2002/0039976 | A1 | 4/2002 | Sebillotte-Arnaud et al. |
| 2002/0058595 | A1 | 5/2002 | Kaiser |
| 2002/0133886 | A1 | 9/2002 | Severns et al. |
| 2003/0110580 | A1 | 6/2003 | Burkinshaw et al. |
| 2003/0134759 | A1 | 7/2003 | Geary et al. |
| 2004/0025262 | A1 | 2/2004 | Hamers et al. |
| 2004/0171515 | A1 | 9/2004 | Hamers et al. |
| 2004/0242133 | A1 | 12/2004 | Arellano et al. |
| 2004/0266641 | A1 | 12/2004 | Gentschev et al. |
| 2005/0148479 | A1 | 7/2005 | Barthel et al. |
| 2005/0153865 | A1 | 7/2005 | Detering et al. |
| 2005/0183206 | A1 | 8/2005 | Brown et al. |
| 2005/0183208 | A1 | 8/2005 | Scheper et al. |
| 2005/0204477 | A1 | 9/2005 | Casella et al. |
| 2006/0189506 | A1 | 8/2006 | Muller et al. |
| 2006/0287212 | A1 | 12/2006 | Sommer et al. |
| 2007/0151312 | A1 | 7/2007 | Bruce et al. |
| 2007/0256251 | A1 | 11/2007 | Orlich et al. |
| 2007/0270327 | A1 | 11/2007 | Beck et al. |
| 2008/0090746 | A1 | 4/2008 | Penninger |
| 2008/0223406 | A1 | 9/2008 | Lindqvist et al. |
| 2008/0276965 | A1 | 11/2008 | Aykroyd et al. |
| 2008/0306183 | A1 | 12/2008 | Leukel et al. |
| 2009/0090138 | A1 | 4/2009 | Wang |
| 2009/0186795 | A1 | 7/2009 | Feenstra et al. |
| 2009/0217461 | A1 | 9/2009 | Burkinshaw et al. |
| 2009/0276966 | A1 | 11/2009 | Mette et al. |
| 2010/0281928 | A1 | 11/2010 | Martin |
| 2011/0296628 | A1 | 12/2011 | Jenkins et al. |
| 2012/0048299 | A1 | 3/2012 | Jenkins et al. |
| 2012/0060350 | A1 | 3/2012 | Kwon et al. |
| 2012/0111359 | A1 | 5/2012 | Mueller et al. |
| 2012/0284931 | A1 | 11/2012 | Jenkins et al. |
| 2012/0304400 | A1 | 12/2012 | Jenkins et al. |
| 2013/0061404 | A1 | 3/2013 | Jenkins |
| 2013/0167882 | A1 | 7/2013 | Burkinshaw et al. |
| 2013/0276242 | A1 | 10/2013 | Jenkins et al. |
| 2013/0281345 | A1 | 10/2013 | Burkinshaw et al. |
| 2013/0283542 | A1 | 10/2013 | Jenkins et al. |
| 2013/0305560 | A1 | 11/2013 | Jenkins et al. |
| 2013/0340487 | A1 | 12/2013 | Yin et al. |
| 2014/0123402 | A1 | 5/2014 | He et al. |
| 2014/0137340 | A1 | 5/2014 | Burkinshaw et al. |
| 2014/0189961 | A1 | 7/2014 | He et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2015/0344824 | A1 | 12/2015 | Burkinshaw et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |

FOREIGN PATENT DOCUMENTS

| | | | |
|---|---|---|---|
| CN | 101006108 | A | 7/2007 |
| CN | 101885605 | A | 11/2010 |
| CN | 101886321 | A | 11/2010 |
| CN | 102061588 | A | 5/2011 |
| CN | 102061589 | A | 5/2011 |
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |

(56) References Cited

FOREIGN PATENT DOCUMENTS

| | | | |
|---|---|---|---|
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202401272 | U | 8/2012 |
| CN | 202492706 | U | 10/2012 |
| CN | 202500017 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| DE | 1900002 | A1 | 7/1970 |
| DE | 2819233 | A1 | 11/1979 |
| DE | 3527724 | A1 | 2/1987 |
| DE | 3803195 | A1 | 8/1989 |
| DE | 19505921 | A1 | 8/1996 |
| DE | 10247289 | A1 | 4/2004 |
| DE | 102007029485 | A1 | 1/2009 |
| DE | 102008009462 | A1 | 8/2009 |
| DE | 102009046170 | A1 | 5/2011 |
| EP | 0090372 | A1 | 10/1983 |
| EP | 0171215 | A1 | 2/1986 |
| EP | 0312278 | A2 | 4/1989 |
| EP | 0807463 | A2 | 11/1997 |
| EP | 1371718 | A1 | 12/2003 |
| EP | 2103677 | A1 | 9/2009 |
| FR | 2525645 | A1 | 10/1983 |
| FR | 2826548 | A1 | 1/2003 |
| GB | 1018318.4 | | 1/1966 |
| GB | 920791 | A | 3/1968 |
| GB | 1256064 | A | 12/1971 |
| GB | 1297316 | A | 11/1972 |
| GB | 1379742 | A | 1/1975 |
| GB | 2249104 | A | 4/1992 |
| GB | 2302553 | A | 1/1997 |
| GB | 2365648 | A | 2/2002 |
| GB | 2456407 | A | 7/2009 |
| GB | 2473224 | A | 3/2011 |
| JP | S59-48078 | A | 3/1984 |
| JP | S59-196758 | A | 11/1984 |
| JP | H01285188 | A | 11/1989 |
| JP | H0257295 | A | 2/1990 |
| JP | H03-146094 | B2 | 6/1991 |
| JP | H04105633 | A | 7/1992 |
| JP | H04241165 | A | 8/1992 |
| JP | H06240297 | A | 8/1994 |
| JP | 2004-167345 | A | 6/2004 |
| JP | 2004238602 | A | 8/2004 |
| JP | 2006-326434 | A | 12/2006 |
| TW | 231275 | B | 10/1994 |
| WO | WO-98/37270 | A1 | 8/1998 |
| WO | WO-99/40251 | A1 | 8/1999 |
| WO | WO-00/37540 | A1 | 6/2000 |
| WO | WO-00/77153 | A1 | 12/2000 |
| WO | WO-02/42403 | A1 | 5/2002 |
| WO | WO-03/054128 | A1 | 7/2003 |
| WO | WO-2004/066970 | A1 | 8/2004 |
| WO | WO-2006/020789 | A1 | 2/2006 |
| WO | WO-2006/040539 | A1 | 4/2006 |
| WO | WO-2007/070520 | A2 | 6/2007 |
| WO | WO-2007/128962 | A1 | 11/2007 |
| WO | WO-2008/132456 | A1 | 11/2008 |
| WO | WO-2009/021919 | A2 | 2/2009 |
| WO | WO-2009/112296 | A1 | 9/2009 |
| WO | WO-2009/134018 | A2 | 11/2009 |
| WO | WO-2010/046473 | A1 | 4/2010 |
| WO | WO-2010/094959 | A1 | 8/2010 |
| WO | WO-2010/128337 | A2 | 11/2010 |
| WO | WO-2010/133837 | A1 | 11/2010 |
| WO | WO-2010/139689 | A1 | 12/2010 |
| WO | WO-2011/015429 | A2 | 2/2011 |
| WO | WO-2011/051140 | A1 | 5/2011 |
| WO | WO-2011/064581 | A1 | 6/2011 |
| WO | WO-2011/098815 | A1 | 8/2011 |
| WO | WO-2011/128676 | A1 | 10/2011 |
| WO | WO-2011/128680 | A2 | 10/2011 |
| WO | WO-2012/035342 | A1 | 3/2012 |
| WO | WO-2012/035343 | A1 | 3/2012 |
| WO | WO-2012/056252 | A2 | 5/2012 |
| WO | WO-2012/084619 | A1 | 6/2012 |
| WO | WO-2012/095677 | A2 | 7/2012 |
| WO | WO-2012/098408 | A2 | 7/2012 |
| WO | WO-2012/104861 | A1 | 8/2012 |
| WO | WO-2012/140442 | A1 | 10/2012 |
| WO | WO-2014/006424 | A1 | 1/2014 |
| WO | WO-2014/006425 | A1 | 1/2014 |
| WO | WO-2014/037729 | A1 | 3/2014 |
| WO | WO-2015/004444 | A1 | 1/2015 |

OTHER PUBLICATIONS

U.S. Appl. No. 14/427,046, Xeros Ltd.

U.S. Appl. No. 14/588,510, Xeros Ltd.

Migneault et al., "Glutaraldehyde: behavior in aqueous solution, reaction with proteins, and application to enzyme crosslinking," Biotechniques. 37(5):790-802 (2004).

Silva et al., "Laccase immobilization on enzymatically functionalized polyamide 6,6 fibres," Enzyme Microb Technol. 41:867-75 (2007).

Talbert et al., "Chitosan-tethered microspheres for lactase immobilization," J Mol Catal B Enzym. 78:78-84 (2012).

U.S. Appl. No. 14/412,100, Xeros Ltd.

U.S. Appl. No. 14/412,298, Xeros Ltd.

U.S. Appl. No.14/505,964, Xeros Ltd.

U.S. Appl. No. 14/505,978, Xeros Ltd.

(56) References Cited

OTHER PUBLICATIONS

U.S. Appl. No. 14/550,359, Xeros Ltd.
U.S. Appl. No. 14/577,285, Xeros Ltd.
U.S. Appl. No. 14/588,500, Xeros Ltd.
"Aqua Ball Set", <http://www.auravita.com/products/AURA/TAPR10610.asp>, retrieved on Aug. 14, 2006 (3 pages).
"Capture Carpet Cleaning Kit", <http://www.basichomeshopping.com/CaptureCarpetCleanerKit.html>, retrieved on Aug. 11, 2005 (4 pages).
"Capture Carpet Cleaning Kit", <http://www.domesticsale.com/Classifieds/15175.html>, retrieved on Aug. 11, 2005 (1 page).
Michalon et al., "Enzyme coupling method on calibrated nylon spheres: application to the selective trypsinization of histones in chromatin," Biochem Biophys Res Commun. 167(1):9-15 (1990).
Search Report for Application No. GB1319782.7, dated Feb. 27, 2014 (4 pages).
U.S. Appl. No. 15/510,569, Xeros Ltd.
U.S. Appl. No. 15/510,576, Xeros Ltd.
U.S. Appl. No. 15/513,014, Xeros Ltd.
U.S. Appl. No. 15/513,309, Xeros Ltd.
U.S. Appl. No. 15/518,047, Xeros Ltd.
U.S. Appl. No. 15/532,137, Xeros Ltd.
Shukla et al., "Immobilisation of amylase by various techniques," Indian Journal of Fibre & Textile Research 29:75-81 (2005).

CLEANING METHOD INCLUDING USE OF SOLID PARTICLES

FIELD OF THE INVENTION

The present invention relates to a cleaning method involving a cleaning apparatus that employs a solid particulate material for the cleaning of soiled substrates. The present invention can facilitate the use of only limited quantities of energy, water and detergent during the cleaning process. Most particularly, the present invention is concerned with the operation of a cleaning apparatus in such a way so as to improve the mechanical cleaning action of the solid particulate material on the soiled substrates contained therein.

BACKGROUND TO THE INVENTION

Aqueous cleaning processes are a mainstay of conventional domestic and industrial textile fabric cleaning methods. On the assumption that the desired level of cleaning is achieved, the efficacy of such conventional processes is usually characterised by their levels of consumption of energy, water and detergent. In general, the lower the requirements with regard to consumption of one or more of these three components, the more efficient the washing process is deemed. The downstream effect of reduced water and detergent consumption can also be significant, as this minimises the need for disposal of aqueous effluent, which can be both extremely costly and detrimental to the environment.

Such washing processes involve aqueous submersion of fabrics followed by soil removal, aqueous soil suspension, and water rinsing. In general, within practical limits, the higher the level of energy (or temperature), water and detergent which is used, the better the cleaning. One key issue, however, concerns water consumption, as this sets the energy requirements (in order to heat the wash water), and the detergent dosage (to achieve the desired detergent concentration). In addition, the water usage level defines the mechanical action of the process on the fabric, which is another important performance parameter. That is, the agitation of the cloth surface during washing, plays a significant role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. reduce energy, water and detergent consumption), and the need for efficient mechanical action in the wash.

Various different approaches to the development of new cleaning technologies have been reported in the prior art, including methods which rely on electrolytic cleaning or plasma cleaning, in addition to approaches which are based on ozone technology, ultrasonic technology or steam technology. Thus, for example, WO2009/021919 teaches a fabric cleaning and disinfection process which utilises UV-produced ozone along with plasma. An alternative technology involves cold water washing in the presence of specified enzymes, whilst a further approach which is particularly favoured relies on air-wash technology and, for example, is disclosed in US2009/0090138. In addition, various carbon dioxide cleaning technologies have been developed, such as the methods using ester additives and dense phase gas treatments which are described in U.S. Pat. No. 7,481,893 and US2008/0223406, although such methods generally find greater applicability in the field of dry cleaning. Many of these technologies are, however, technically very complex.

In the light of the challenges which are associated with aqueous washing processes, the present applicant has previously devised a new approach to the problem that allows the deficiencies demonstrated by the methods of the prior art to be mitigated or overcome. The method which is provided eliminates the requirement for the use of large volumes of water, but is still capable of providing an efficient means of cleaning and stain removal, whilst also yielding economic and environmental benefits.

Thus, in WO2007/128962 there is disclosed a method and formulation for cleaning a soiled substrate, the method comprising the treatment of the moistened substrate with a formulation comprising a multiplicity of polymeric particles, wherein the formulation is free of organic solvents. The substrate may be wetted so as to achieve a substrate to water ratio of between 1:0.1 to 1:5 w/w, and optionally, the formulation additionally comprises at least one cleaning material, which typically comprises a surfactant, which most preferably has detergent properties. In the disclosed embodiments, the substrate comprises a textile fibre. The polymeric particles may, for example, comprise particles of polyamides, polyesters, polyalkenes, polyurethanes or their copolymers, a particular example being nylon beads.

The use of this cleaning method, however, presents a requirement for the nylon beads to be efficiently separated from the cleaned substrate at the conclusion of the cleaning operation. In addition to this problem, the present applicant also identified that the provision of means to enable continuous circulation of the nylon beads during the cleaning operation would further improve the process. These issues were addressed in WO2011/098815 wherein the present applicant provided an apparatus for use in the cleaning of soiled substrates, the apparatus comprising housing means having a first upper chamber with a rotatably mounted cylindrical cage mounted therein and a second lower chamber located beneath the cylindrical cage, and additionally comprising at least one recirculation means, access means, pumping means and a multiplicity of delivery means, wherein the rotatably mounted cylindrical cage comprises a drum having perforated side walls where up to 60% of the surface area of the side walls comprises perforations comprising holes having a diameter of no greater than 25.0 mm.

WO2011/098815 further discloses the use of the apparatus in methods for the cleaning of soiled substrates with formulations comprising solid particulate cleaning material and wash water, the methods typically comprising the steps of:

a. introducing solid particulate cleaning material and water into the lower chamber of the apparatus;
b. agitating and heating the solid particulate cleaning material and water;
c. loading at least one soiled substrate into the rotatably mounted cylindrical cage via the access means;
d. closing the access means so as to provide a substantially sealed system;
e. introducing the solid particulate cleaning material and water into the rotatably mounted cylindrical cage;
f. operating the apparatus for a wash cycle, wherein the rotatably mounted cylindrical cage is caused to rotate and wherein fluids and solid particulate cleaning material are caused to fall through perforations in the rotatably mounted cylindrical cage into the lower chamber in a controlled manner;

g. operating the pumping means so as to transfer fresh solid particulate cleaning material and recycle used solid particulate cleaning material to separating means;

h. operating control means so as to add the fresh and recycled solid particulate cleaning material to the rotatably mounted cylindrical cage in a controlled manner; and i. continuing with steps (f), (g) and (h) as required to effect cleaning of the soiled substrate.

As outlined in WO2011/098815 the generation of suitable G forces, in combination with the action of the solid particulate cleaning material, was found to be an important factor in achieving an appropriate level of cleaning of the soiled substrate. Thus in embodiments disclosed in WO2011/098815, the cylindrical cage is rotated at a speed of 30 to 800 rpm in order to generate G forces of 0.49 to 350.6 at different stages of the cleaning process. In one preferred embodiment disclosed in WO2011/098815, rotation of the rotatably mounted cylindrical cage is caused to occur at a G force of less than 1 during the wash cycle. Much higher G forces, for example between 10 and 1000, are disclosed to be generated only on completion of the wash cycle and to effect a measure of drying of the cleaned substrate when the feeding of solid particulate material into the cage has ceased.

Although the methods disclosed in WO2007/128962 and WO2011/098815 provided considerable improvements for the cleaning of soiled substrates with formulations comprising solid particulate material and wash water, the present inventors have recognised that there remains scope for improvement.

The present inventors have recognised the opportunity for enhanced cleaning of substrates without requiring the use of higher or additional amounts of detergent-containing cleaning agents.

The present inventors have further recognised that the solid particulate material can become localised in certain areas of the drum. Such localisation can lead to a less than optimal distribution of said particulate material throughout the soiled substrates which can lead to a limiting of the maximum obtainable cleaning performance.

The present invention seeks to provide a method for cleaning of soiled substrates with a solid particulate material that can ameliorate or overcome above-noted problems associated with the prior art.

Preferably, the present invention seeks to provide a method for cleaning of soiled substrates with a solid particulate material which can provide enhanced cleaning of the substrate.

More preferably, the present invention seeks to provide a method for cleaning of soiled substrates with a solid particulate material which can provide enhanced cleaning of the substrate and which method does not require the use of higher or additional amounts of detergent-containing cleaning agents.

Preferably, the present invention can provide a method of cleaning soiled substrates with a solid particulate material which can ameliorate or overcome one or more of the above-noted problems.

The present inventors have recognised that a cleaning method which provides an increased and/or prolonged mechanical interaction between the solid particulate material and a soiled substrate within the cleaning apparatus can facilitate an enhanced degree of cleaning of the substrate. The inventors have further recognised such a method can provide an enhanced cleaning effect without increasing the quantity of cleaning agents utilised in the cleaning process.

The present inventors have further recognised that an improved distribution of said particulate material within the drum, and more especially on entry to the drum, can provide an enhanced degree of cleaning of the substrate.

The present inventors have recognised that many of the abovementioned technical problems become more significant as the drum size is reduced (e.g. for domestic washing machines) and/or as the ullage (free space) in the drum is reduced (e.g. because the drum is highly loaded with a soiled substrate).

SUMMARY OF THE INVENTION

According to a first aspect of the present invention there is provided a method for cleaning at least one soiled substrate in a rotatably mounted cylindrical drum of a cleaning apparatus, the method comprising:

rotating the drum such that said at least one soiled substrate describes an annular path whereby a central portion of the drum is not occupied by any soiled substrate and introducing a multiplicity of solid particles into said central portion of the drum.

Said "multiplicity of solid particles" is also referred to herein as "solid particulate material" without any difference in meaning.

Thus, advantageously, the multiplicity of solid particles is introduced into the drum when the soiled substrates are urged against the inner wall of the drum. The present inventors consider that by causing the solid particulate material to be directed into a central portion of an annulus defined by the soiled substrates as they rotate in the drum, the entry of the multiplicity of solid particles into the drum is not impeded by the substrate and an enhanced distribution of the solid particulate material within the drum and enhanced mechanical interaction of the solid particulate material with the soiled substrates can thus be achieved.

Preferably, said drum is caused to rotate at a G force of at least at least 1, and preferably greater than 1. Preferably, said drum is caused to rotate at a G force of between 1 and 10.

Preferably, the multiplicity of solid particles is introduced into the drum along a trajectory which, at the location of entry of the particles to the drum, is substantially parallel to the axis of the drum.

As used herein "substantially parallel to the axis of the drum" preferably indicates a maximum divergence from a line exactly parallel to the axis of the drum of not more than about 15°, such as not more than 10°, or not more than 5°, or not more than 2° and in particular not more than 1°.

Preferably, the method further comprises the step of moistening said at least one soiled substrate with water prior to introducing said multiplicity of solid particles into the drum.

Preferably, the method further comprises the step of introducing at least one additional cleaning agent into the drum.

Preferably, the method comprises introducing said at least one additional cleaning agent into the drum following the introduction of said multiplicity of solid particles into the drum.

Preferably, said at least one additional cleaning agent comprises at least one detergent composition. Optionally, said at least one detergent composition comprises cleaning components and post-treatment components.

Said cleaning components are suitably selected from the group consisting of: surfactants, enzymes and bleach.

Said post-treatment components are suitably selected from the group consisting of: anti-redeposition additives, perfumes and optical brighteners.

The method may further comprise introducing at least one additive into said drum wherein said at least one additive is selected from the group consisting of: builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and pigments.

Preferably, the method comprises operating the cleaning apparatus for a wash cycle wherein during said wash cycle the drum is caused to rotate such that said at least one soiled substrate describes an annular path whereby a central portion of the drum is not occupied by any soiled substrate for a first period and wherein the drum is further caused to rotate such that said at least one soiled substrate does not describe an annular path for a second period. Preferably, the drum is caused to rotate at a G force of at least 1 for said first period, especially said drum is caused to rotate at a G force of greater than 1 for said first period. Typically said drum is caused to rotate at a G force of between 1 and 10 for said first period.

Preferably, the drum is caused to rotate at a G force of less than 0.7 for said second period.

The sequence outlined above for said wash cycle is typically repeated one or more times. Thus, the sequence of a first period followed by a second period is preferably conducted at least twice, and typically no more than 10 times. Advantageously, the method comprises periodically varying the G force during the wash cycle such that said at least one soiled substrate describes an annular path for one period and does not describe an annular path for another period, which can further enhance the distribution of said multiplicity of solid particles throughout the washload.

Preferably, the method comprises operating said cleaning apparatus for a wash cycle wherein said wash cycle comprises one or more cleaning stages and wherein said one or more cleaning stages comprise causing said drum to rotate at a G force that is not greater than 10.

According to a second aspect of the present invention there is provided a method for cleaning at least one soiled substrate in a rotatably mounted cylindrical drum of a cleaning apparatus with a multiplicity of solid particles comprising the steps of:

a) agitating said at least one soiled substrate in said drum with wash liquor and said multiplicity of solid particles for a first cleaning cycle wherein said wash liquor comprises at least one cleaning agent;

b) draining said wash liquor from said cleaning apparatus; and c) introducing an aqueous non-detergent medium into said cleaning apparatus and agitating said at least one soiled substrate with said multiplicity of solid particles in said drum for a second cleaning cycle.

Advantageously, the method according to the second aspect of the invention provides a second cleaning cycle in which said aqueous non-detergent medium is introduced to the cleaning apparatus to the exclusion of any additional cleaning agent.

The aqueous non-detergent medium of the second cleaning cycle is preferably different to the wash liquor of the first cleaning cycle.

Advantageously, the aqueous non-detergent medium is water alone.

Alternatively, the aqueous non-detergent medium can comprise water with one or more treatment additives. Suitable treatment additives can include dye transfer inhibiting agents, optical brighteners, dyes, pigments, starches, anti-re-deposition additives, perfumes, and processing aids. Particular examples of these types of additives indicated elsewhere in this specification can be useful in the method according to the second aspect of the present invention.

It will appreciated that the second cleaning cycle of the method may utilise the multiplicity of solid particles residing in the apparatus following a first cleaning cycle thereby prolonging the duration of mechanical action on the soiled substrate but without requiring the introduction of additional cleaning media into the cleaning apparatus.

The wash liquor can comprise at least one cleaning agent wherein said at least one cleaning agent comprises a detergent composition. The at least one detergent composition can comprise cleaning components and post-treatment components. The cleaning components can be selected from the group consisting of: surfactants, enzymes and bleach. The post-treatment components can be selected from the group consisting of: anti-redeposition additives, perfumes and optical brighteners. The wash liquor can comprise one or more additives as detailed further hereinbelow.

The composition of the wash liquor may depend at any given time on the point which has been reached in the cleaning cycle for the soiled substrate carrying out the methods of the invention. Thus, for example, at the start of the cleaning cycle, the wash liquor may comprise water in combination with at least one cleaning agent. At a later point in the cleaning cycle the wash liquor may include detergent and/or one of more of the below mentioned additives. During a cleaning stage of the cleaning cycle, the wash liquor may further include suspended soil removed from the substrate.

Typically, the wash liquor further comprises at least one additive selected from the group consisting of: builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and pigments.

The second cleaning cycle is thus suitably substantially free from detergent. In this context the term "substantially free from detergent" does not exclude the presence of negligible amounts of residual detergent remaining in the cleaning apparatus after wash liquor has been drained following the first cleaning cycle. However, in such cases, no additional detergent is added for the second cleaning cycle nor are significant amounts of detergent carried over from the first cleaning cycle. Advantageously, the method according to the second aspect of the present invention can provide a prolonged cleaning effect on the soiled substrate in the absence of detergent thereby demonstrating environmental benefits.

Preferably, said first cleaning cycle comprises rotating the drum such that said at least one soiled substrate describes an annular path whereby a central portion of the drum is not occupied by any soiled substrate. Preferably, said first cleaning cycle comprises introducing a multiplicity of solid particles into said central portion of the drum. Preferably, the multiplicity of solid particles is introduced into the drum along a trajectory which, at the location of entry of the particles to the drum, is substantially parallel to the axis of the drum.

Preferably, said second cleaning cycle comprises rotating the drum and introducing a multiplicity of solid particles into the drum as said drum rotates.

Preferably, said second cleaning cycle comprises rotating the drum such that said at least one soiled substrate describes an annular path whereby a central portion of the drum is not occupied by any soiled substrate. Preferably, said second cleaning cycle comprises introducing a multiplicity of solid particles into said central portion of the drum. Preferably, the multiplicity of solid particles is introduced into the drum along a trajectory which, at the location of entry of the particles to the drum, is substantially parallel to the axis of the drum.

Preferably, the method of the second aspect of the invention comprises causing the drum to rotate at a G force of at least 1, and more preferably greater than 1, and typically at a G force of no more than 10. Typically, the method of the second aspect of the present invention comprises causing the drum to rotate at a G force of between 1 and 10.

Preferably, the first cleaning cycle comprises causing the drum to rotate such that said at least one soiled substrate describes an annular path whereby a central portion of the drum is not occupied by any soiled substrate for a first period and wherein the drum is further caused to rotate such that said at least one soiled substrate does not describe an annular path for a second period. Preferably, said drum is caused to rotate at a G force of at least 1 for said first period and even more especially greater than 1 for said first period. Typically, said drum is caused to rotate at a G force of between 1 and 10 for said first period. Preferably, the drum is caused to rotate at a G force of less than 0.7 for said second period. The sequence outlined above for said first cleaning cycle can, optionally, be repeated one or more times. Thus, the sequence of a first period followed by a second period is preferably conducted at least twice, and typically no more than 10 times.

Preferably, the second cleaning cycle comprises causing the drum to rotate such that said at least one soiled substrate describes an annular path whereby a central portion of the drum is not occupied by any soiled substrate for a first period and wherein the drum is further caused to rotate such that said at least one soiled substrate does not describe an annular path for a second period. Preferably, said drum is caused to rotate at a G force of at least 1 for said first period and especially greater than 1 for said first period. Typically, said drum can is caused to rotate at a G force of between 1 and 10 for said first period. Preferably, the drum is caused to rotate at a G force of less than 0.7 for said second period. The sequence outlined above for said second cleaning cycle can, optionally, be repeated one or more times. Thus, the sequence of a first period followed by a second period is preferably conducted at least twice, and typically no more than 10 times.

Preferably, the method further comprises causing the drum to rotate at a G force of greater than 10 at the end of said first cleaning cycle to extract fluids from said drum.

Preferably, the volume of fluid used in the cleaning apparatus for the second cleaning cycle is less than the volume of fluid used in the cleaning apparatus for the first cleaning cycle.

Preferably, the cleaning apparatus comprises a sump wherein said wash liquor is drained from the sump after said first cleaning cycle and wherein further water is added to said sump for said second cleaning cycle.

Preferably, said drum in the methods of said first aspect and said second aspect of the invention is mounted about a substantially horizontal axis.

Preferably, said drum in the methods of said first aspect and said second aspect of the invention comprises a rotatably mounted cylindrical cage comprising perforated side walls wherein said perforations comprise holes having a diameter of no greater than 5.0 mm. Preferably, said perforations comprise holes having a diameter of no greater than 3.0 mm.

Preferably, said drum in the methods of said first aspect and said second aspect of the invention has a capacity of 10 to 7000 liters, or a capacity of 10 to 700 liters, or a capacity of 30 to 150 liters.

Typically, the cleaning apparatus in the methods according to said first aspect and said second aspect of the invention is a washing machine. The cleaning apparatus can be a domestic washing machine such as a machine configured for location in a private dwelling such as a house or apartment. Alternatively, the cleaning apparatus can be a commercial washing machine.

Preferably in the methods according to said first aspect and said second aspect of the invention, said at least one soiled substrate can comprise a textile material, in particular one or more garments, linens, napery, towels or the like.

According to a third aspect of the present invention there is provided a cleaning apparatus for use in the cleaning of at least one soiled substrate with a multiplicity of solid particles comprising:

a housing including (a) a rotatably mounted drum;

(b) a drive device configured to rotate the drum;

(c) a collecting volume;

(d) a pumping device;

(e) a circulation pathway by which said multiplicity of solid particles and a transporting fluid can be transferred from the collecting volume to the drum via said pumping device;

(f) an electronic controller configured to control the operation of the apparatus, the electronic controller comprising a processor and a memory comprising logical instructions that when executed by the processor:

i. cause the drive device to rotate the drum such that said at least one soiled substrate contained in the drum describes an annular path whereby a central portion of the drum is not occupied by any soiled substrate and ii. cause the pumping device to introduce a multiplicity of solid particles into said central portion of the drum.

The transporting fluid can be water or wash liquor, depending, for example, on the particular stage which has been reached in a cleaning cycle.

Preferably, said logical instructions cause the drum to rotate at a G force of at least 1 and even more especially at a G force of greater than 1.

Typically, said logical instructions cause the drum to rotate at a G force between about 1 and 10.

Preferably, said logical instructions when executed by the processor cause the apparatus to execute a wash cycle wherein during said wash cycle the drum is caused to rotate by said drive device for a first period in which that said at least one soiled substrate describes an annular path whereby a central portion of the drum is not occupied by any soiled substrate and the drum is further caused to rotate by said drive device for a second period in which that said at least one soiled substrate does not describe an annular path.

According to a fourth aspect of the present invention there is provided a cleaning apparatus for use in the cleaning of at least one soiled substrate with a multiplicity of solid particles comprising:

a housing including (a) a rotatably mounted drum;

(b) a drive device configured to rotate the drum;

(c) a collecting volume;

(d) a pumping device;

(e) a circulation pathway by which said multiplicity of solid particles and a transporting fluid can be transferred from the collecting volume to the drum via said pumping device;

(f) an electronic controller configured to control the operation of the apparatus, the electronic controller comprising a processor and a memory comprising logical instructions that when executed by the processor cause the apparatus to:

i. execute a first cleaning cycle in which wash liquor and said multiplicity of solid particles are introduced into the drum, said wash liquor comprising at least one cleaning agent and said at least one soiled substrate in said drum is agitated with wash liquor and said multiplicity of solid;

ii. drain said wash liquor from said cleaning drum; and iii. execute a second cleaning cycle in which an aqueous non-detergent medium is introduced into said cleaning apparatus and said at least one soiled substrate is agitated with said multiplicity of solid particles in said drum.

Preferably, said logical instructions when executed cause, in said first cleaning cycle, the drive means to rotate the drum such that said at least one soiled substrate describes an annular path whereby a central portion of the drum is not occupied by any soiled substrate.

Preferably, said logical instructions when executed cause said pumping device to introduce said multiplicity of solid particles into said central portion of the drum.

Preferably, said logical instructions when executed cause, in said second cleaning cycle, the drive means to rotate the drum such that said at least one soiled substrate describes an annular path whereby a central portion of the drum is not occupied by any soiled substrate.

Preferably, said logical instructions when executed cause said pumping device to introduce said multiplicity of solid particles into said central portion of the drum.

Preferably, said logical instructions when executed in said first cleaning cycle cause the drive means to rotate the drum for a first period in which said at least one soiled substrate describes an annular path whereby a central portion of the drum is not occupied by any soiled substrate and cause the drive means to rotate the drum for a second period in which said at least one soiled substrate does not describe an annular path.

Preferably, said logical instructions when executed in said second cleaning cycle cause the drive means to rotate the drum for a first period in which said at least one soiled substrate describes an annular path whereby a central portion of the drum is not occupied by any soiled substrate and cause the drive means to rotate the drum for a second period in which said at least one soiled substrate does not describe an annular path.

Preferably, the drum has a capacity in the region of 10 to 7000 liters, more preferably in the region of 30 to 150 liters.

Preferably, the cleaning apparatus according to the third and fourth aspects of the present invention is a domestic washing machine.

Alternatively, the cleaning apparatus according to the third and fourth aspect of the present invention is a commercial washing machine.

The multiplicity of solid particles or solid particulate material as referred to herein is distinguished from, and should not be construed as being, a conventional washing powder (that is laundry detergent in powder form). Washing powder is generally soluble in the wash water and is included primarily for its detergent qualities. The washing powder is disposed of during the wash cycle since it is sent to drain in grey water along with removed soil. In contrast, a significant function of the multiplicity of solid particles referred to herein is a mechanical action on the substrate which enhances cleaning of the substrate.

Preferably, the multiplicity of solid particles comprises or consists of a multiplicity of polymeric particles.

Alternatively, the multiplicity of solid particles comprises or consists of a multiplicity of non-polymeric particles.

Alternatively, the multiplicity of solid particles comprises or consists of a mixture of polymeric solid particles and non-polymeric solid particles.

Preferably, the polymeric particles are selected from particles of polyalkenes, polyamides, polyesters, polysiloxanes, polyurethanes or copolymers thereof.

Preferably, the polymeric particles comprise particles selected from particles of polyalkenes or copolymers thereof.

Preferably, the polymeric particles comprise particles selected from particles of polyamide or polyester or copolymers thereof.

Preferably, the polyester particles comprise particles of polyethylene terephthalate or polybutylene terephthalate.

Preferably, the polyamide particles comprise particles of nylon, more preferably said nylon can comprise Nylon 6 or Nylon 6,6.

Preferably, the non-polymeric particles comprise particles of glass, silica, stone, wood, metals or ceramic materials.

Preferably, the polymeric particles have an average density of from about 0.5 to about 2.5 g/cm$^3$.

Preferably, the non-polymeric particles have an average density of from about 3.5 to about 12.0 g/cm$^3$.

For the avoidance of doubt, "density" in the preceding paragraphs refers to the density of the particle as such, in contrast to the bulk density of a mass of particles.

Preferably, the multiplicity of solid particles is in the form of beads.

Preferably, the solid particles are reused one or more times for cleaning of said at least one soiled substrate.

Preferably, the methods of the invention are carried out so as to achieve a wash liquor to substrate ratio of between about 5:1 to 0.1:1 w/w in said drum.

Preferably, the ratio of multiplicity of solid particles to substrate being cleaned is in the range of from about 0.1:1 to about 30:1 w/w. Such a ratio applies to the ratio of said multiplicity of solid particles to substrate in the drum according to the first aspect of the method of the present invention, and also applies to the ratio of said multiplicity of solid particles to substrate in the drum in each of said first and second cleaning cycles according to the second aspect of the method of the present invention.

It will be understood from the above statements and from the foregoing description that any of the features described in relation to the any one aspect of the invention can be combined with any of the features described in relation to another aspect of the invention unless the description expressly indicates the contrary or unless it would be clearly understood from the context that such a combination is not possible.

BRIEF DESCRIPTION OF THE DRAWINGS

The invention will now be further illustrated by reference to the following drawings, wherein.

DETAILED DESCRIPTION OF THE INVENTION

The present inventors have recognised advantages in reducing the usage of water, energy and/or detergents in a cleaning process while maintaining or improving cleaning performance. The present inventors seek to achieve such reduction by using cleaning methods and apparatus which can clean soiled substrates using a solid particulate material. In particular, the inventors have appreciated that an increase in the extent and/or duration of mechanical interaction of the solid particulate material with the soiled substrates can be effective in improving cleaning performance.

Figure 1:
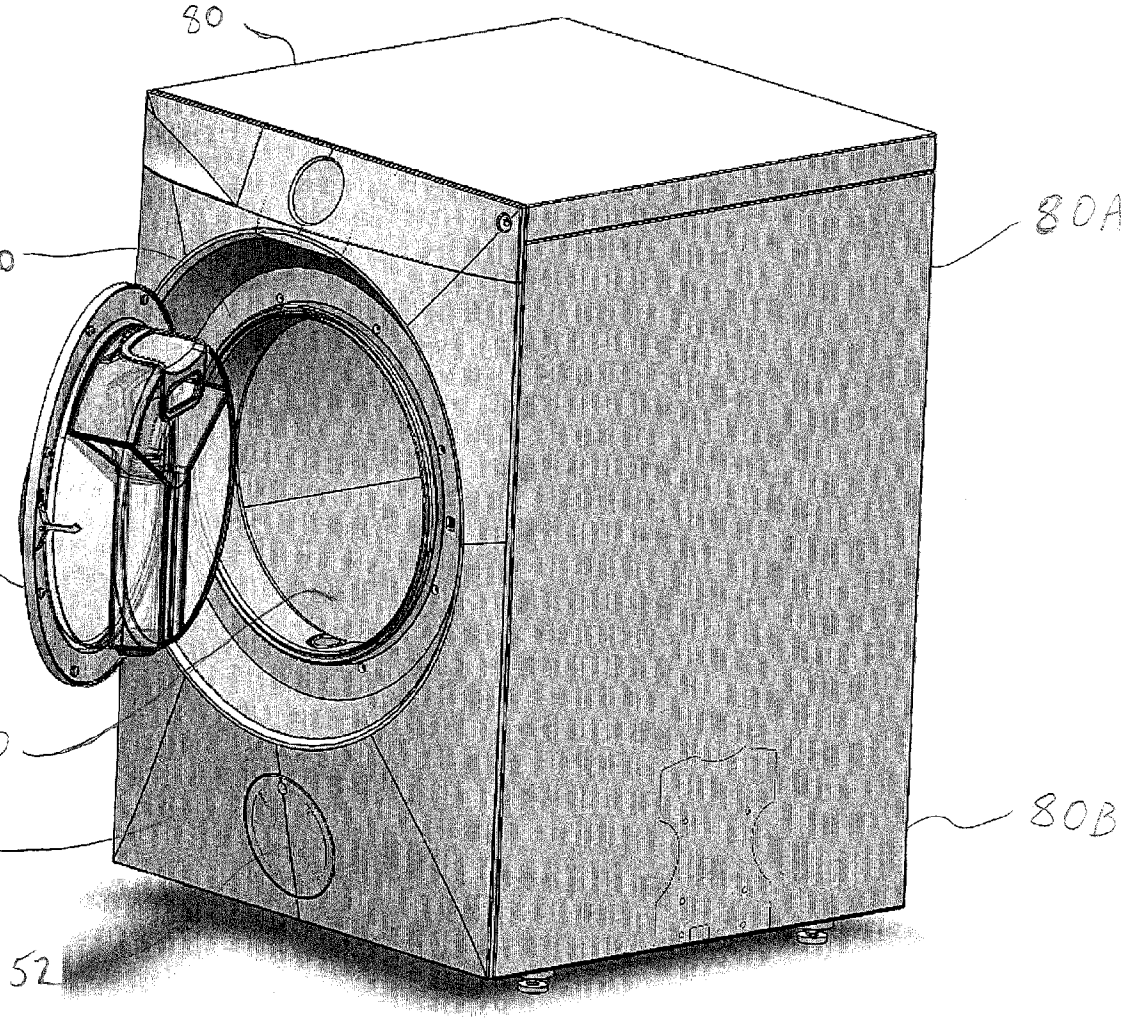
FIG. 1 shows an external view of the cleaning apparatus for use in the methods according the present invention and according to the third and fourth aspect of the present invention.
Figure 2:
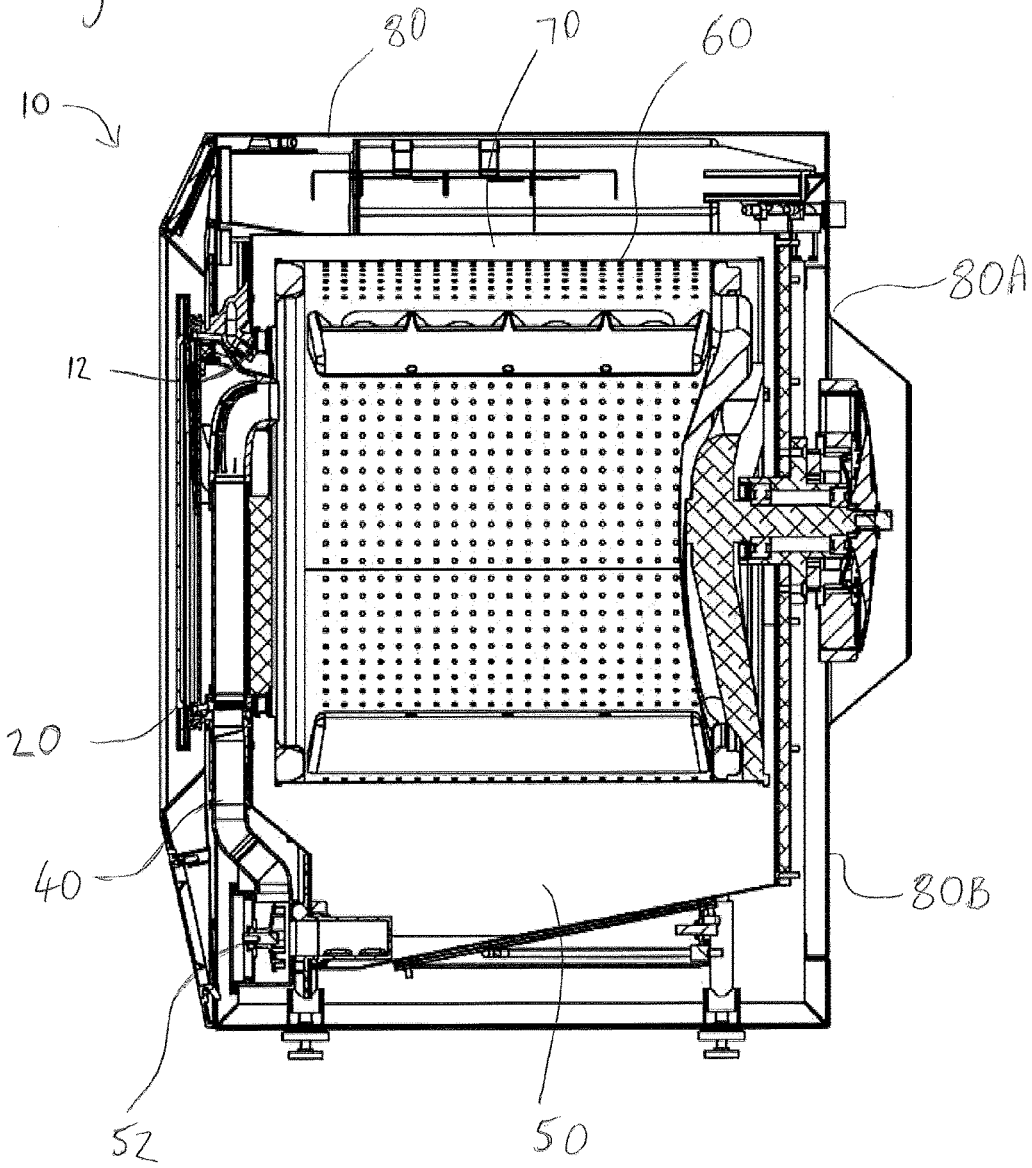
FIG. 2 shows a cross-sectional side view of the cleaning apparatus for use in the methods according to the present invention and according to the third and fourth aspects of the present invention.

Referring to FIGS. 1 and 2, there is provided a cleaning apparatus (10) comprising a housing (80). The housing (80) can comprise an upper portion (80A) and a lower portion (80B). The housing (80) comprises therein a rotatably mounted cylindrical drum (60). Preferably, the drum (60) is located in the upper portion of the housing (80A). The drum (60) can be mounted in a casing or tub (70).

Preferably, the drum (60) is in the form of a rotatably mounted cylindrical cage. Thus, the drum (60) can comprise perforated side walls (perforations shown in FIG. 2), wherein said perforations comprise holes having a diameter of from 2 to 25 mm. More preferably, said perforations comprise holes having a diameter of from 2 to 10 mm. Preferably, said perforations comprise holes having a diameter of no greater than 5 mm. Optionally, said perforations comprise holes having a diameter of no greater than 3 mm.

Said perforations permit the ingress and egress of fluids and fine particulate materials of lesser diameter than the holes, but are adapted (typically of such as size) so as to prevent the egress of said solid particulate material.

Alternatively and more preferably, said perforations permit the ingress and egress of fluids and said solid particulate material.

The cleaning apparatus (10) can comprise a door (20) to allow access to the interior of the drum (60). The door (20) may be hingedly coupled or mounted to a portion of the tub (70). In other embodiments the door can be hingedly coupled or mounted to the upper portion of the housing (80A). The door (20) can be moveable between an open and a closed position. When the door (20) is moved to an open position access can be permitted to the interior of the drum (60) so that soiled substrates such as garments, linens, napery, towels or the like can be placed inside. When the door (20) is moved to a closed position, the cleaning apparatus (10) is substantially sealed.

The drum (60) can be mounted about an essentially horizontal axis within the housing (80). Consequently, said door (20) is located in the front of the cleaning apparatus (10), thereby providing a front-loading facility.

Rotation of said drum (60) can be effected by use of drive means, which typically can comprise electrical drive means, in the form of an electric motor. Operation of said drive means can be effected by control means which may be operated by a user.

Preferably, the methods of the invention involve the generation of suitable G forces in combination with the action of the solid particulate cleaning material in order to elicit an improved cleaning effect on the soiled substrates contained in the drum. G is a function of the drum size and the speed of rotation of the drum and, specifically, is the ratio of the centripetal force generated at the inner surface of the drum to the static weight of the washload. Thus, for a drum of inner radius r (m), rotating at R (rpm), with a washload of mass M (kg), and an instantaneous tangential velocity of the drum v (m/s), and taking g as the acceleration due to gravity at 9.81 m/s$^2$:

$$\text{Centripetal force}=Mv^2/r$$

$$\text{Washload static weight}=Mg$$

$$v=2\pi rR/60$$

$$\text{Hence, } G=4\pi^2r^2R^2/3600rg=4\pi^2rR^2/3600g=1.118\times 10^{-3}rR^2$$

When, as is usually the case, r is expressed in centimeters, rather than meters, then:

$$G=1.118\times10^{-5}rR^2$$

Hence, for a drum of radius 28 cm rotating at 150 rpm, G=7.04.

The drum (60) can be caused to rotate at a speed such that the soiled substrates contained therein become urged against and therefore stuck to the inner cylindrical walls of the drum. The rotational speed of the drum is just sufficient to substantially prevent the clothes from tumbling or falling from an interior wall of the drum as the drum rotates. The soiled substrates can thus be caused to describe an annular path. There can be defined a void or space extending in an axial direction through the drum and the centre of the annular path when the drum is rotating at this speed. The soiled substrates when rotating with the drum can define an annulus or resemble a "doughnut" shape during this stage of drum rotation wherein said void or space is the centre of the doughnut or annulus.

In order to urge the soiled substrates against the inner cylindrical walls of the drum and thereby form a doughnut, the drum (60) can be spun such that G is at least 1. For a drum of diameter 56 cm, G=1 at a drum rotation speed of 61 rpm. If, during the wash cycle, G is reduced to less than the doughnut forming value as described, then the doughnut collapses as there is insufficient G force to retain the soiled substrate(s) against the inner cylindrical walls of the drum. Preferably, the methods according to the present invention utilise this effect to maximise the distribution and mechanical action of solid particulate material on the washload.

The cleaning operation of the invention can involve a number of stages. In order to provide additional lubrication to the cleaning apparatus and thereby improve the transport properties within the system, water can be added. Thus, more efficient transfer of the solid particulate cleaning material to the substrate is facilitated, and removal of soiling and stains from the substrate can occur more readily. The solid particulate material can thus elicit a cleaning effect on the substrate and water can simply aid the transport of said solid particulate material.

Prior to loading into the cleaning apparatus, the soiled substrate may be moistened by wetting, preferably with mains or tap water. Preferably however, wetting of the substrate with water occurs within the cleaning apparatus of the invention.

In any event, water can be added to the drum (60) of the invention such that the washing treatment is carried out so as to achieve a wash water or wash liquor to substrate ratio in the drum (60) which, is between 5:1 and 0.1:1 w/w. More preferably, the wash liquor to substrate ratio is between 2.5:1 and 0.1:1 w/w and even more preferably between 2.0:1 and 0.8:1 w/w. By means of example, particularly favourable results have been achieved at ratios of the wash liquor to substrate such as 1.75:1, 1.5:1, 1.2:1 and 1.1:1 w/w. Most conveniently, the required amount of water is introduced after loading of the soiled substrate into the drum (60).

As described herein, "wash liquor" pertains to an aqueous medium used in the cleaning apparatus and can comprise water when combined with at least one cleaning agent. The at least one cleaning agent can comprise a detergent composition and/or any further additives as detailed further hereinbelow.

The cleaning apparatus (10) according to the third or fourth aspects of the present invention, or as used in the methods of the present invention, can comprise at least one delivery means. The delivery means can facilitate the entry of wash liquor constituents (notably water and/or cleaning agents) directly (that is, otherwise than by way of the sump (50) and pumping means (52) as herein described below) to the drum (60) as required. The cleaning apparatus (10) can comprise a multiplicity of delivery means. Suitable delivery means can include one or more spraying means such as a spray nozzle (12). The delivery means can deliver, for example, water, one or more cleaning agents or water in combination with said one or more cleaning agents. Typically, the delivery means can be mounted on a portion of the door (20).

Preferably, the drum (60) is caused to rotate such that G is about 1 or greater than 1 and water can be simultaneously introduced into the drum (60) in order to initially moisten the soiled substrates. Preferably, water is introduced into the drum (60) whilst it is being caused to rotate such that G is between about 1 and 10. Advantageously, this enables the soiled substrates to resemble a doughnut or annular configuration thereby ensuring a uniform wetting of the substrates prior to the introduction of the solid particulate material and/or one or more cleaning agents. Preferably, water is introduced so that it is directed into the centre of the doughnut or annulus. Water can thus be directed in a direction generally parallel to the rotational axis of the drum (60). Preferably, said water is introduced by said delivery means.

Following suitable moistening of the soiled substrates, solid particulate material can be introduced into the drum (60). Preferably, the cleaning apparatus (10) can comprise a sump (50) which can function as a chamber for storing the solid particulate material. The sump (50) can be located in a lower portion of the housing (80B). In addition, the sump (50) can further contain water and/or water when combined with one or more cleaning agents (i.e. wash liquor). Furthermore, the sump (50) can comprise heating means allowing its contents to be raised to a preferred temperature for use in the cleaning operation. In some embodiments the heating means can comprise one or more heater pads attached to the outer surface of the sump (50). Prior to commencement of the cleaning operation, water can be added to the solid particulate material in the sump (50). When a threshold or desired volume of water is present in the sump (50), the water and solid particulate material can be pumped into the drum (60). Preferably, said water and solid particulate material are pumped into the drum (60) via the door (20). As noted above, water and/or one or more cleaning agents can also be added from the delivery means into the drum (60) and ultimately any fluids can be transferred (e.g. via perforations in the walls of the rotatably mounted cage) to the sump (50). Thus, during the course of the wash cycle, the contents of the sump (50) can comprise water in combination with one or more cleaning agents and the solid particulate material.

The cleaning apparatus (10) can comprise pumping means (52) to pump water and/or one or more cleaning agents plus the solid particulate material. In some embodiments pumping means (52) can be located in the lower portion of the housing (80B) and can be located in or connected to the sump (50). Preferably, the pumping means (52) are adapted to pump said water and/or said cleaning agents with the solid particulate material from the sump (50) into the drum (60) via the door (20).

Preferably, following moistening of the soiled substrates, solid particulate material is introduced into the drum (60) whilst it is being caused to rotate such that G is about 1 or greater than 1. Typically, solid particulate material is introduced into the drum (60) whilst it is being caused to rotate such that G is between about 1 and 10. As noted above, the soiled substrates thus resemble a doughnut or annular configuration when the drum is rotating at this speed and the solid particulate material can be introduced into the drum (60) so that it is directed into the centre of the doughnut or annulus. The solid particulate material can thus be introduced along a trajectory which, at the location of entry of the particles to the drum, is substantially parallel to the axis of the drum (60). Preferably, the solid particulate material enters the drum (60) via the door (20). Advantageously, the solid particulate material is directed to the centre of the washload facilitating its improved distribution throughout the soiled substrates when the drum continues to rotate as the wash cycle progresses. Furthermore, as the soiled substrates are urged against the inner cylindrical walls there is increased ullage (free space) within the drum. The solid particulate material is therefore provided greater freedom to move within the drum interior and interact with the soiled substrates as the drum rotates. As a result, the inventors consider that the mechanical action of the solid particulate material on the surface of the soiled substrates can be advantageously increased.

Preferably, one or more cleaning agents are introduced into the drum (60) immediately following the introduction of the solid particulate material whilst the drum (60) is being caused to rotate such that G is about 1 or greater than 1. Preferably, said one or more cleaning agents are introduced into the drum (60) whilst it is being caused to rotate such that G is between about 1 and 10. The one or more cleaning agents can comprise, for example, a detergent composition which may include one or more further additives. The one or more cleaning agents can be introduced so that the cleaning agents are directed into the centre of the doughnut or annulus. The cleaning agents can thus be directed in a direction generally parallel to the rotational axis of the drum (60). Said cleaning agents may be introduced by said delivery means. Advantageously, the cleaning agents are introduced to reside in essentially the same location as the solid particulate material. For example, the one or more cleaning agents can be sprayed on top of the solid particulate material by said delivery means. When the drum continues to rotate as the wash cycle progresses, the solid particulate material facilitates an improved distribution of the cleaning agents and enhanced interaction with the soiled substrates in the drum. The drum (60) may be caused to rotate such that G is reduced to less than about 1 after said one or more cleaning agents have been introduced to the drum so as to collapse the doughnut thereby enabling the entire washload to be effectively covered by the cleaning agents.

Following the introduction of the solid particulate material and wash liquor (i.e. water when combined with the one or more cleaning agents) as outlined above, the drum (60) can continue to rotate to effect cleaning of the soiled substrates. Rotation of the drum (60) can be such that G is reduced so that the soiled substrates do not describe an annular path as the drum rotates at one or more points during the course of the wash cycle. For example, a drum of diameter 49 cm can typically be caused to rotate at a speed of about 30 rpm to 40 rpm during the course of the wash cycle. When the rotation speed of a drum of 49 cm diameter is reduced from 61 rpm to 40 rpm, G is reduced from 1 to 0.44 (i.e. less than 1), the doughnut or annular configuration previously adopted by the soiled substrates collapses and the substrates exhibit a tumbling motion as the drum rotates. Advantageously, the change in the motion of the substrates from rotating about an essentially annular path to tumbling further improves the distribution of the solid particulate material throughout the washload.

Preferably, the drum is caused to rotate in a sequence such that G is about 1 or greater than 1 and is then reduced to less than about 1 for one or more stages during the wash cycle. The reduction in G to less than about 1 will be sufficient to cause any doughnut or annular configuration previously adopted by the soiled substrates to collapse. For example, the drum can be caused to rotate such that G is about 1 or greater than 1 for 8 periods during the wash cycle thereby enabling the formation of 8 respective doughnuts during the cycle. In such preferred cases G can be reduced to less than about 1 for each interval prior to the formation of a "new" doughnut (i.e. there may be 7 corresponding intervening periods wherein G is reduced to less than about 1 in order to collapse the doughnut). The number of doughnuts formed and subsequently collapsed can be modified in accordance with the desired total duration of a particular wash cycle.

Preferably, the solid particulate material is introduced into the drum at regular intervals during the wash cycle. Thus, for example, the solid particulate material is introduced into the drum in a plurality of pulses wherein each pulse equates to a predetermined period. Preferably, at least some of the pulses of said solid particulate material occur whilst the drum is being caused to rotate such that G is about 1 or greater than 1 (i.e. coincide with the presence of a doughnut). For example, in one particular case every fifth pulse of solid particulate material into the drum coincides with the presence of a doughnut. Said predetermined period is typically from about 1 second to about 60 seconds in duration. Each pulse is typically spaced apart by about 1 second to about 60 seconds, for example each pulse may be spaced apart by about 4 seconds to about 30 seconds.

Preferably, the methods of the invention comprise operating said cleaning apparatus for a wash cycle wherein said wash cycle comprises one or more cleaning stages and wherein said one or more cleaning stages can comprise causing said drum (60) to rotate at a G force that is not greater than 10. If, alternatively, the drum (60) is caused to rotate at a G force of greater than 10 throughout the wash cycle, an excessive extraction of fluids from the drum can occur before an effective cleaning interaction between the substrates, wash liquor and solid particulate material has been achieved.

The present invention provides a method which extends the length of time for which the soiled substrates are in contact with the solid particulate material thereby enhancing the overall cleaning effect, and thus disclosed herein is a method comprising cleaning at least one soiled substrate in a rotatably mounted cylindrical drum of a cleaning apparatus with a multiplicity of solid particles comprising the steps of:

a) agitating said at least one soiled substrate in said drum with wash liquor and said multiplicity of solid particles for a first cleaning cycle wherein said wash liquor comprises at least one cleaning agent;

b) draining said wash liquor from said cleaning apparatus; and c) introducing aqueous non-detergent medium into said cleaning apparatus and agitating said at least one soiled substrate with said multiplicity of solid particles in said drum for a second cleaning cycle.

In this method, the cleaning apparatus, wash liquor and solid particulate material can comprise any of the features as herein described above. Preferably, the at least one soiled substrate is agitated by rotation of said cylindrical drum (60). In addition, the at least one soiled substrate can be moistened as described above. Preferably, the first cleaning cycle comprises introducing solid particulate material into the drum (60) whilst it is being caused to rotate such that the substrate(s) contained therein adopts a doughnut shape as outlined above. Preferably, the first cleaning cycle comprises causing the drum (60) to rotate in a sequence such that G is about 1 or greater than 1 and then reduced to less than about 1 for one or more stages during the first cleaning cycle in a similar fashion to that described above. In other, less preferred embodiments, the drum can be caused to rotate such that G is less than about 1 as the solid particulate material is introduced to the drum such that the substrates do not adopt a doughnut configuration.

At the end of the first cleaning cycle, the drum (60) is suitably caused to rotate at a high speed to promote the egress of fluids, including wash liquor, from the drum. Such cycles are often referred to as "spin cycles". Preferably, the drum (60) is caused to rotate such that G is greater than 10. Preferably, the drum (60) is caused to rotate such that G is greater than 50.

Following completion of the first cleaning cycle, wash liquor can then be drained away from the cleaning apparatus. Thus, it will be appreciated that in the cleaning apparatus of the fourth aspect of the invention, said logical instructions cause the apparatus to drain said wash liquor from said cleaning apparatus. Dirty (grey) water containing soil from the substrates in the drum is thus extracted from the cleaning apparatus. Particularly, said wash liquor can be drained from the cleaning apparatus via the sump (50). Solid particulate material utilised in the first cleaning cycle is not however purposely removed from the drum. Consequently, solid particulate material remaining in the drum following the first cleaning cycle is suitably reused in the second cleaning cycle. Preferably, the wash liquor is drained away from the cleaning apparatus at the same time as the drum (60) is being caused to rotate at high speed to promote the egress of fluids, including wash liquor, from the drum.

After wash liquor has been drained from the cleaning apparatus, the sump (50) can be replenished with fresh water for use in the second cleaning cycle. Once a threshold or desired volume of water has been added to the sump (50), the water and solid particulate material can again be pumped into the drum (60) in order to commence the second cleaning cycle. Preferably, water introduced into the drum (60) for the second cleaning cycle is substantially free from detergent. One purpose of the second cleaning cycle is to extend the contact time of the soiled substrates with the solid particulate material. Such extended contact time can facilitate an improved cleaning effect without requiring the introduction of additional detergent or cleaning agents. Furthermore, solid particulate material remaining in the cleaning apparatus following the first cleaning cycle can be efficiently reused.

The volume of liquid in the cleaning apparatus for the second cleaning cycle is suitably less than the volume of liquid in the cleaning apparatus for the first cleaning cycle. Water usage in the second cleaning cycle can simply be for the purpose of transporting the solid particulate material from the sump to the drum.

Preferably, the second cleaning cycle comprises causing the drum to rotate such that G is about 1 or greater than 1. As noted above, rotating the drum at this speed enables the soiled substrates to adopt a doughnut or annular configuration. The second cleaning cycle preferably further comprises introducing solid particulate material into the drum whilst the drum is being caused to rotate such that G is about 1 or greater than 1. The solid particulate material can be introduced into the drum so that it is directed into the centre of the doughnut or annulus. The solid particulate material can thus be directed along a trajectory which, at the location of entry of the particles to the drum, is substantially parallel to the axis of the drum (60). The solid particulate material may enter the drum (60) via the door (20).

Preferably, the drum (60) in the second cleaning cycle is caused to rotate in a sequence such that G is about 1 or greater than 1 and then reduced to less than about 1 for one or more stages during the wash cycle. For example, the drum (60) can be caused to rotate such that G is about 1 or greater than 1 for a predetermined number of periods (preferably 3 periods) during the second cleaning cycle thereby enabling the formation of a predetermined number (preferably 3) of respective doughnuts during the cycle. In such embodiments G can be reduced to less than about 1 for each interval prior to the formation of a "new" doughnut (e.g. there may be 2 intervening periods wherein G is reduced to less than about 1 in order to collapse the doughnut).

Preferably, the solid particulate material is introduced into the drum (60) at regular intervals during the second cleaning cycle. Thus, the solid particulate material may be introduced into the drum (60) in a plurality of pulses wherein each pulse equates to a predetermined period. Preferably, at least some of the pulses of said solid particulate material occur whilst the drum (60) is caused to rotate such that G is about 1 or greater than 1 (i.e. coincide with the presence of a doughnut). In some embodiments said predetermined period can be from about 1 second to about 60 seconds in duration. Preferably, each pulse is spaced apart by about 1 second to about 60 seconds, more preferably each pulse is spaced apart by about 4 seconds to about 30 seconds.

At the end of the second cleaning cycle, the drum (60) is preferably caused to rotate at a high speed to promote the egress of fluids, including wash liquor, from the drum. Preferably, the drum (60) is caused to rotate such that G is greater than 10 and more preferably such that G is greater than 50.

Following completion of the second cleaning cycle, wash liquor (i.e. predominantly water) can again be drained away from the cleaning apparatus. Preferably, the wash liquor is drained away from the cleaning apparatus at the same time as the drum (60) is being caused to rotate at high speed to promote the egress of fluids, including wash liquor, from the drum.

Preferably, the method further comprises a rinsing step. This can involve first draining any remaining wash liquor or water from the cleaning apparatus following the previous cleaning cycle(s) and then introducing additional water whilst agitating the soiled substrates in the drum (60). Additional water can be introduced into the drum (60) via the delivery means (e.g. the spray head). During this stage no additional solid particulate material is typically introduced to the drum (60). Typically, such a step can be performed near the end of the wash cycle and prior to removal of the solid particulate material from the drum (60).

On completion of the wash cycle there can be performed a sequence to remove any solid particulate material remaining in the drum (60). This sequence can comprise a series of slow speed rotations and counter rotations to facilitate transfer of the solid particulate material from the drum (60) to the sump (50).

The cleaning apparatus of, and used in, the aspects of the present invention described herein can be a commercial washing machine (sometimes referred to as a washer extractor). Said drum (60) can be of the size which is to be found in most commercially available washing machines and tumble driers, and can have a capacity in the region of 10 to 7000 liters. A typical capacity for a domestic washing machine would be in the region of 30 to 150 liters whilst, for an industrial washer extractor, capacities anywhere in the range of from 150 to 7000 liters are possible. A typical size in this range is that which is suitable for a 50 kg washload, wherein the drum has a volume of 450 to 650 liters and, in such cases, said drum (60) would generally comprise a cylinder with a diameter in the region of 75 to 120 cm, preferably from 90 to 110 cm, and a length of between 40 and 100 cm, preferably between 60 and 90 cm.

The cleaning apparatus of, and used in, the aspects of the present invention described herein can be a domestic washing machine. Typically said domestic washing machine can comprise a drum (60) having a capacity of from 30 to 150 liters. The rotatably mounted drum (60) can have a capacity of from 50 to 150 liters. Generally the drum (60) of said domestic washing machine will be suitable for a 5 to 15 kg washload. Here the drum (60) can typically comprise a cylinder with a diameter in the region of 40 to 60 cm and a length in the region of 25 cm to 60 cm. Here the drum (60) can typically have 20 to 25 liters of volume per kg of washload to be cleaned.

Typically, the housing (80) or cabinet of the cleaning apparatus can have a length dimension of from about 40 cm to about 120 cm, a width dimension of from about 40 cm to about 100 cm and a height of from about 70 cm to about 140 cm.

The housing (80) or cabinet of the cleaning apparatus may have a length dimension of from about 50 cm to about 70 cm, a width dimension of from about 50 cm to about 70 cm and a height of from about 75 cm to about 95 cm. In particular, the housing (80) or cabinet of the cleaning apparatus can have a length dimension of about 60 cm, a width dimension of about 60 cm and a height of about 85 cm. The cleaning apparatus can be comparable in size to a typical front-loading domestic washing machine commonly used in the Europe.

In another embodiment, the housing (80) or cabinet of the cleaning apparatus can have a length dimension of from about 50 cm to about 100 cm, a width dimension of from about 40 cm to about 90 cm and a height of from about 70 cm to about 130 cm. In particular, the housing (80) or cabinet can have a length dimension of from about 70 cm to about 90 cm, a width dimension of from about 50 cm to about 80 cm and a height of from about 85 cm to about 115 cm. More particularly, the housing (80) or cabinet of the cleaning apparatus can have a length dimension of from about 77.5 cm to about 82.5 cm, a width dimension of from about 70 cm to about 75 cm and a height of from about 95 cm to about 100 cm. More particularly, the housing (80) or cabinet of the cleaning apparatus can have a length dimension of about 71 cm (28 inches), a width dimension of about 80 cm (31.5 inches) and a height of about 96.5 cm (38 inches). The cleaning apparatus can be comparable in size to a typical front-loading domestic washing machine commonly used in the USA.

The cleaning apparatus (10) is designed to operate in conjunction with soiled substrates and cleaning media comprising a solid particulate material, which preferably is in the form of a multiplicity of polymeric or non-polymeric particles. These polymeric or non-polymeric particles can be efficiently circulated to promote effective cleaning and the cleaning apparatus (10), therefore, can include circulation means. Thus, the inner surface of the cylindrical side walls of said rotatably mounted cylindrical cage (60) can comprise a multiplicity of spaced apart elongated protrusions affixed essentially perpendicularly to said inner surface. Optionally, said protrusions additionally comprise air amplifiers which are typically driven pneumatically and are adapted so as to promote circulation of a current of air within said cage. Typically said cleaning apparatus (10) can comprise from 3 to 10, preferably 4, of said protrusions, which are commonly referred to as lifters.

The cleaning apparatus (10) can comprise lifters which collect the solid particulate material and transfer it to a lower portion of the housing (80B). Particularly said lifters can facilitate transportation of the solid particulate material to the sump (50) in said lower portion of the housing (80B). The lifters can comprise collecting and transferring means in the form of a plurality of compartments. The lifters can be located at equidistant intervals on the inner circumferential surface of the drum (60).

In operation, agitation is provided by rotation of said drum (60) of said cleaning apparatus (10). However, there may also be provided additional agitating means, in order to facilitate the efficient removal of residual solid particulate material at the conclusion of the cleaning operation, and said agitating means can comprise an air jet.

Typically, the housing (80) includes standard plumbing features, in addition to said multiplicity of delivery means, by virtue of which at least water and, optionally, cleaning agents such as surfactants, can be circulated in said cleaning apparatus (10).

The cleaning apparatus (10) can additionally comprise means for circulating air within said housing (80), and for adjusting the temperature and humidity therein. Said means may typically include, for example, a recirculating fan, an air heater, a water atomiser and/or a steam generator. Additionally, sensing means can also be provided for determining, inter alia, the temperature and humidity levels within the cleaning apparatus (10), and for communicating this information to control means which can be worked by an operative.

The cleaning apparatus (10) can comprise means to recirculate the water/wash liquor and the solid particulate material. The solid particulate material can be recirculated from the lower portion of the housing (80B) to the upper portion of the housing (80A). Recirculation of the solid particulate material enables its re-use in the cleaning operation. Preferably, the solid particulate cleaning material is recirculated along a path between the sump (50) and the drum (60). To facilitate transport of said solid particulate material along said recirculation path, the cleaning apparatus (10) can comprise ducting (40) extending from a lower portion of the housing (80B). The pumping means (52) can be adapted to pump said solid particulate material and water/wash liquor along said recirculation path via the ducting (40).

The cleaning apparatus (10) can comprise a door (20) wherein the door (20) comprises a separator. Water or wash liquor pumped from the sump (50) can be separated from the solid particulate material by the action of the separator. The separator can further act to facilitate the direction of the solid particulate material into the drum (60). Any water or wash liquor which does not enter the drum (60) can be returned to the sump (50) via a suitable drain.

The cleaning methods according to the invention are principally designed for use in the cleaning of substrates comprising a textile material, in particular one or more garments, linens, napery, towels or the like. The cleaning methods of the invention have been shown to be particularly successful in achieving efficient cleaning of textile fibres which may, for example, comprise either natural fibres, such as cotton, wool, silk or man-made and synthetic textile fibres, for example nylon 6,6, polyester, cellulose acetate, or fibre blends thereof.

The solid particulate material for use in the invention can comprise a multiplicity of polymeric particles or a multiplicity of non-polymeric particles. Preferably, the solid particulate material comprises a multiplicity of polymeric particles. Alternatively, the solid particulate material comprises a mixture of polymeric particles and non-polymeric particles. In other embodiments, the solid particulate material comprises a multiplicity of non-polymeric particles. Thus, the solid particulate material can comprise exclusively polymeric particles, exclusively non-polymeric particles or mixtures of polymeric and non-polymeric particles.

The polymeric particles or non-polymeric particles can be of such a shape and size as to allow for good flowability and intimate contact with the substrate and particularly with textile fibre. A variety of shapes of particles can be used, such as cylindrical, ellipsoidal, spherical or cuboid; appropriate cross-sectional shapes can be employed including, for example, annular ring, dog-bone and circular. Non-polymeric particles comprising naturally occurring minerals such as stone may have various shapes, dependent on their propensity to cleave in a variety of different ways during manufacture. In some embodiments, the particles can comprise generally ellipsoidal, cylindrical or spherical beads.

The polymeric particles or non-polymeric particles can have smooth or irregular surface structures and can be of solid, porous or hollow structure or construction.

Preferably, the polymeric particles are of such a size as to have an average mass of about 1 mg to about 70 mg, more preferably about 1 mg to about 50 mg, even more preferably about 1 mg to about 35 mg, especially from about 10 mg to about 30 mg and most preferably from about 12 mg to about 25 mg.

Preferably, the non-polymeric particles are of such a size as to have an average mass of about 1 mg to about 1 g, more preferably from about 10 mg to 100 mg and even more preferably from about 25 mg to about 100 mg.

Preferably, the polymeric or non-polymeric particles have a surface area of 10 $mm^2$ to 120 $mm^2$, more preferably 15 $mm^2$ to 50 $mm^2$, especially 15 $mm^2$ to 50 $mm^2$ and most especially 20 $mm^2$ to 40 $mm^2$. Preferably, the polymeric particles have an average density in the range of from about 0.5 to about 2.5 $g/cm^3$. Preferably, the polymeric particles have an average density in the range of from about 0.55 to about 2.0 $g/cm^3$ and more preferably from about 0.6 to about 1.9 $g/cm^3$.

Preferably, the non-polymeric particles have an average density greater than the polymeric particles. Thus, preferably, the non-polymeric particles have an average density in the range of about 3.5 to about 12.0 $g/cm^3$, more preferably about 5.0 to about 10.0 $g/cm^3$ and especially from about 6.0 to about 9.0 $g/cm^3$.

Preferably, the average volume of the polymeric and non-polymeric particles is in the range of 5 to 275 $mm^3$, more preferably 8 to 140 $mm^3$ and especially 10 to 120 $mm^3$.

Preferably, the polymeric or non-polymeric particles are substantially ellipsoidal, substantially cylindrical or substantially spherical in shape.

The cylindrical particles may be of oval cross section. In such embodiments, the major cross section axis length, a, is preferably in the region of from 2.0 to 6.0 mm, preferably from 2.2 to 5.0 mm and preferably from 2.4 mm to 4.5 mm. The minor cross section axis length, b, is preferably in the region of from 1.3 to 5.0 mm, preferably from 1.5 to 4.0 mm and preferably from 1.7 mm to 3.5 mm. For an oval cross section, a>b. The length, h, of the cylindrical particles is preferably in the range of from about 1.5 mm to about 6.0 mm, preferably from about 1.7 mm to about 5.0 mm, and preferably from about 2.0 mm to about 4.5 mm. The ratio h/b is typically in the range of from about 0.5 to about 10.

The cylindrical particles may also be of circular cross section. The typical cross section diameter, $d_c$, is in the region of from 1.3 to 6.0 mm, more typically from 1.5 to 5.0 mm, and more typically from 1.7 mm to 4.5 mm. The length of such particles, $h_c$, is preferably in the range of from about 1.5 mm to about 6.0 mm, preferably from about 1.7 mm to about 5.0 mm and preferably from about 2.0 mm to about 4.5 mm. The ratio $h_c/d_c$ can typically be in the range of from about 0.5 to about 10.

The particles may be generally spherical in shape (but not a perfect sphere) having a particle diameter, $d_s$, in the region of from 2.0 to 8.0 mm, preferably from 2.2 to 5.5 mm and typically from about 2.4 mm to about 5.0 mm.

The particles can be perfectly spherical in shape having a particle diameter, $d_{ps}$, in the region of from 2.0 to 8.0 mm, preferably from 3.0 to 7.0 mm and typically from about 4.0 mm to about 6.5 mm.

Preferably, the polymeric particles comprise polyalkenes such as polyethylene and polypropylene, polyamides, polyesters, polysiloxanes or polyurethanes. Preferably, said polymeric particles comprise polyamide or polyester particles, particularly particles of nylon, polyethylene terephthalate or polybutylene terephthalate, typically in the form of beads. Said polyamides and polyesters are found to be particularly effective for aqueous stain/soil removal, whilst polyalkenes are especially useful for the removal of oil-based stains.

Various nylon or polyester homo- or co-polymers can be used including, but not limited to, Nylon 6, Nylon 6,6, polyethylene terephthalate and polybutylene terephthalate. Preferably, the nylon comprises Nylon 6,6, preferably having a molecular weight in the region of from about 5000 to about 30000 Daltons, such as from about 10000 to about 20000 Daltons, or such as from about 15000 to about 16000 Daltons. Preferred polyesters have a molecular weight corresponding to an intrinsic viscosity measurement in the range of from about 0.3 to about 1.5 dl/g, as measured by a solution technique such as ASTM D-4603.

Optionally, copolymers of the above polymeric materials may be employed for the purposes of the invention. Specifically, the properties of the polymeric materials can be tailored to specific requirements by the inclusion of monomeric units which confer particular properties on the copolymer. Thus, the copolymers can be adapted to attract particular staining materials by including monomer units in the polymer chain which, inter alia, are ionically charged, or include polar moieties or unsaturated organic groups. Examples of such groups can include, for example, acid or amino groups, or salts thereof, or pendant alkenyl groups.

The polymeric particles can comprise foamed polymers. Alternatively, the polymeric particles can comprise unfoamed polymers. The polymeric particles can comprise polymers which are linear, branched or crosslinked.

Preferably, the non-polymeric particles comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and alloys thereof. Suitable ceramics include, but are not limited to, alumina, zirconia, tungsten carbide, silicon carbide and silicon nitride.

In some cases, said non-polymeric particles can comprise coated non-polymeric particles. Most particularly, said non-polymeric particles can comprise a non-polymeric core material and a shell comprising a coating of a polymeric material. In a particular embodiment, said core can comprise a metal core, typically a steel core, and said shell can comprise a polyamide coating, for example a coating of nylon.

Whilst, in some cases, the methods of the invention envisage the cleaning of a soiled substrate by the treatment of a moistened substrate with a formulation comprising only solid particulate material (i.e. in the absence of any further additives), optionally in other cases the formulation employed can additionally comprise at least one cleaning agent. The at least one cleaning agent can include at least one detergent composition. Said at least one cleaning agent may be introduced into the drum of the cleaning apparatus before or following commencement of the wash cycle. In other cases, said particles comprised in said solid particulate material can be coated with said at least one cleaning agent.

The principal components of the detergent composition can comprise cleaning components and post-treatment components. The cleaning components may comprise surfactants, enzymes and bleach, whilst the post-treatment components can include, for example, anti-redeposition additives, perfumes and optical brighteners.

The formulations for use in the methods of the invention can further optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants that can be included in the detergent composition can be selected from non-ionic surfactants, anionic surfactants, cationic surfactants, ampholytic and/or zwitterionic surfactants, and semi-polar non-ionic surfactants. The surfactant can typically be present at a level of from about 0.1%, from about 1%, or even from about 5% by weight of the cleaning compositions to about 99.9%, to about 80%, to about 35%, or even to about 30% by weight of the cleaning compositions.

The detergent composition can include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, lignin-ases, pullulanases, tannases, pentosanases, malanases, [beta]-glucanases, arabinosidases, hyaluronidase, chondroitinase, laccase, and amylases, or mixtures thereof. A typical combination can comprise a mixture of enzymes such as protease, lipase, cutinase and/or cellulase in conjunction with amylase.

Optionally, enzyme stabilisers can also be included amongst the cleaning components. In this regard, enzymes for use in detergents may be stabilised by various techniques, for example by the incorporation of water-soluble sources of calcium and/or magnesium ions in the compositions.

The detergent composition can include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders can be included as additives and include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The additives can also optionally contain one or more copper, iron and/or manganese chelating agents and/or one or more dye transfer inhibiting agents.

Suitable polymeric dye transfer inhibiting agents for use in the detergent composition include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent composition can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives that can be included in the detergent composition are physico-chemical in their action and include, for example, materials such as polyethylene glycol, polyacrylates and carboxy methyl cellulose.

Optionally, the detergent composition can also contain perfumes. Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

Suitable optical brighteners that can be used in the detergent composition fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl) thiophene.

Said above components can be used either alone or in a desired combination and can be added at appropriate stages during the washing cycle in order to maximise their effects.

Preferably, the ratio of solid particulate material to substrate is generally in the range of from about 0.1:1 to about 30:1 w/w, more preferably from about 0.1:1 to about 20:1 w/w, even more preferably from about 0.1:1 to about 15:1 w/w, especially from about 0.1:1 to about 10:1 w/w, more especially from about 0.5:1 to about 5:1 w/w, even more especially from about 1:1 and about 3:1 w/w and, most especially, around 2:1 w/w. Thus, for example, for the cleaning of 5 kg of fabric, 10 kg of polymeric or non-polymeric particles are suitably employed. Such ratios apply to the ratio of said multiplicity of solid particles to substrate in the drum according to the first aspect of the method of the present invention, and also apply to the ratio of said multiplicity of solid particles to substrate in the drum in each of said first and second cleaning cycles according to the second aspect of the method of the present invention. The ratios apply similarly to the third and fourth aspects of the invention. In particular, where the method comprises a second cleaning cycle, it is preferred that solid particulate material (i.e. the multiplicity of solid particles referred to herein) is suitably introduced into the drum as the drum rotates in the second cleaning cycle such that the ratio of solid particulate material to substrate in the second cleaning cycle is in the range of from about 0.1:1 to about 30:1 w/w, more preferably from about 0.1:1 to about 20:1 w/w, even more preferably from about 0.1:1 to about 15:1 w/w, especially from about 0.1:1 to about 10:1 w/w, more especially from about 0.5:1 to about 5:1 w/w, even more especially from about 1:1 and about 3:1 w/w and, most especially, around 2:1 w/w.

Preferably, the ratio of solid particulate material to substrate is maintained at a substantially constant level during certain stages of the wash cycle. Consequently, pumping of fresh and recycled or recirculated solid particulate material can proceed at a rate sufficient to maintain approximately the same level of solid particulate material in the drum at a given point in the cleaning operation, and to thereby ensure that the ratio of solid particulate material to soiled substrate stays substantially constant until that particular stage of the wash cycle has been completed.

The apparatus and the methods of the present invention can be used for either small- or large-scale batch-wise processes and find application in both domestic and industrial cleaning processes. The present invention may be applied to domestic washing machines and processes.

As previously noted, the methods of the invention find particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits.

Typical procedures and conditions for the wash cycle require that fabrics are generally treated according to the methods of the invention at, for example, temperatures of between 5 and 95° C., preferably for a duration of between about 5 and 120 minutes. Thereafter, additional time may be required for the completion of any further stages of the overall process. Typically, the total duration of the entire cycle is typically in the region of between about 1 hour and about 1 hour and 15 minutes. In some cases the total duration of the wash cycle time can be in the region of from about 50 minutes to about 1 hour and 40 minutes. The operating temperatures for the methods of the invention can be in the range of from about 10 to about 60° C. or from about 15 to about 40° C.

It will be appreciated that the cleaning apparatus of, or used in, the present invention is not required to, or does not, comprise a sealing means which is removably attached to the outer surface of the cylindrical side walls of said rotatably mounted cylindrical drum. In particular, it will be appreciated that the cleaning apparatus of, or used in, the present invention does not comprise a removably attached sealing means which is attached to and removed from the outer surface of a rotatably mounted cylindrical drum during a method of cleaning a soiled substrate. It will therefore be appreciated that the methods of the invention described herein do not comprise removal of such a sealing means between a first cleaning cycle and a second cleaning cycle.

It will further be appreciated that the cleaning apparatus of, or used in, the present invention is not required to, or does not, comprise a rotatably mounted cylindrical perforation cage concentrically located within a rotatably mounted cylindrical perforated drum having a greater diameter than said cage, wherein said cage and said drum are concentrically located within a stationary cylindrical drum having a greater diameter than said rotatably mounted drum.

In a preferred embodiment, the present invention provides a method for cleaning at least one soiled substrate in a rotatably mounted cylindrical drum of a cleaning apparatus with a multiplicity of solid particles comprising the steps of:

a) agitating said at least one soiled substrate in said drum with wash liquor and said multiplicity of solid particles for a first cleaning cycle wherein said wash liquor comprises at least one cleaning agent;

b) draining said wash liquor from said cleaning apparatus, preferably wherein the drum is caused to rotate at a G force of greater than 10 to extract fluids from said drum; and c) introducing an aqueous non-detergent medium into said cleaning apparatus and agitating said at least one soiled substrate with said multiplicity of solid particles in said drum for a second cleaning cycle, wherein said second cleaning cycle comprises rotating the drum and introducing a multiplicity of solid particles into the drum as said drum rotates;

d) draining wash liquor away from the cleaning apparatus following completion of the second cleaning cycle, preferably wherein the drum is caused to rotate at a G force of greater than 10 to extract fluids from said drum;

e) a rinsing step comprising introducing additional water whilst agitating the substrate in the drum, preferably such that no additional solid particulate material is introduced to the drum; and f) removing any solid particulate material remaining in the drum, preferably comprising a series of slow speed rotations and counter rotations;

preferably wherein the aqueous non-detergent medium of the second cleaning cycle is different to the wash liquor of the first cleaning cycle;

preferably wherein the first cleaning cycle comprises causing the drum to rotate such that said at least one soiled substrate describes an annular path whereby a central portion of the drum is not occupied by any soiled substrate for a first period and wherein the drum is further caused to rotate such that said at least one soiled substrate does not describe an annular path for a second period, such that in the first cleaning cycle said drum is caused to rotate at a G force of at least 1 and preferably between 1 and 10 for said first period and at a G force of less than 1, and preferably 0.7 or less than 0.7, for said second period;

preferably wherein the second cleaning cycle comprises causing the drum to rotate such that said at least one soiled substrate describes an annular path whereby a central portion of the drum is not occupied by any soiled substrate for a first period and wherein the drum is further caused to rotate such that said at least one soiled substrate does not describe an annular path for a second period, such that in the second cleaning cycle said drum is caused to rotate at a G force of at least 1 and preferably between 1 and 10 for said first period and at a G force of less than 1, and preferably 0.7 or less than 0.7, for said second period; and preferably wherein the multiplicity of solid particles is introduced into the drum at regular intervals during the second cleaning cycle by a plurality of pulses, preferably wherein at least some of the pulses occur whilst the drum is caused to rotate such that G is at least 1 (i.e. to coincide with the substrate describing an annular path).

In a further preferred embodiment, the present invention provides a method for cleaning at least one soiled substrate in a rotatably mounted cylindrical drum of a cleaning apparatus, the method comprising:

rotating the drum such that said at least one soiled substrate describes an annular path whereby a central portion of the drum is not occupied by any soiled substrate and introducing a multiplicity of solid particles into said central portion of the drum, wherein the method comprises operating the cleaning apparatus for a wash cycle wherein during said wash cycle the drum is caused to rotate such that said at least one soiled substrate describes an annular path whereby a central portion of the drum is not occupied by any soiled substrate for a first period and wherein the drum is further caused to rotate such that said at least one soiled substrate does not describe an annular path for a second period, and wherein said drum is caused to rotate at a G force of at least 1 and preferably between 1 and 10 for said first period, and further wherein said drum is caused to rotate at a G force of less than 1 and preferably 0.7 or less than 0.7 for said second period;

draining wash liquor away from the cleaning apparatus, preferably wherein the drum is caused to rotate at a G force of greater than 10 to extract fluids from said drum;

a rinsing step comprising introducing additional water whilst agitating the substrate in the drum, preferably such that no additional solid particulate material is introduced to the drum; and removing any solid particulate material remaining in the drum, preferably comprising a series of slow speed rotations and counter rotations, preferably wherein said multiplicity of solid particles is introduced into the drum at regular intervals during the wash cycle by a plurality of pulses, and preferably at least some of the pulses of said multiplicity of solid particles occur whilst the drum is being caused to rotate such that G at least 1 (i.e. to coincide with the substrate describing an annular path).

The invention will now be further illustrated, though without in any way limiting the scope thereof, by reference to the following examples.

Examples

Cleaning Efficiency Tests

Woven cotton fabric (194 $gm^{-2}$, Whaleys, Bradford, UK) was stained with sebum, carbon black, blood, cocoa and red wine.

Cleaning tests were then carried out using a set of test and control conditions. The tests involved the use of a cleaning apparatus combining the third and fourth aspects of the present invention as hereinbefore described and adapted for use with a solid particulate material of the type described above, and this is referred to hereinbelow as Example 1. The control cleaning tests were carried out using a conventional washing machine suitable for domestic use in the USA (Samsung® WF435ATG). Following loading of the soiled substrates into the domestic washing machine, control cleaning tests were conducted using a standard wash cycle with warm water at a temperature of between 29 and 43° C. for a duration of 1 hour.

The control cleaning tests and the tests using the method combining the first and second aspects of the invention were carried out using the same detergent composition in each case.

By comparison, the cleaning tests for the method of the invention were carried out by first loading the soiled substrates into the drum (60) of the illustrated cleaning apparatus (10), closing the door (20) to seal the apparatus and then causing the drum (60) to rotate at 80 rpm (G=2). Rotation of the drum (60) at this speed caused the substrates to be urged against the inner walls of the drum thereby forming a doughnut. In order to moisten and wet out the substrates in the drum, 4 liters of water was sprayed using the spray head (12) into the middle of the ballast load or doughnut. Solid particulate material in the form of nylon beads was pumped with water upwardly from the sump (50) via the use of pumping means (52). A portion of the beads residing in the sump (50) were then introduced to the drum (60) through the door (20) and directed into the centre of the washload or doughnut over a period of 50 seconds. Then, 4 liters of detergent was sprayed into the middle of the doughnut on top of the beads using spray head (12). The detergent was left to soak into the washload for 5 minutes. Further beads were then introduced to the drum (60) from the sump (50) and the drum rotated at a speed of 47 rpm (G=0.7). Additional beads were introduced to the drum (60) from the sump (50) in a series of pulses occurring every 30 seconds for 20 minutes. To coincide with every fifth pulse, the drum (60) rotation speed was increased to 80 rpm (G=2) so as to create a doughnut and the beads were directed into the centre of the doughnut. The process was continued for 40 bead pulses with 8 doughnuts formed during this stage of the wash cycle. Approximately 14.5 liters of water was used for pumping beads between the sump (50) and the drum (60) throughout this first cleaning stage.

During the course of agitation by rotation of the drum (60), water including any detergent falls through the perforations in the drum (60) and into the sump (50). Beads are transferred to the sump (50) by lifters disposed on the inner circumferential surface of the drum (60) as the drum rotates. On transfer to the sump (50), the pumping means (52) again pumps water in combination with the beads upwardly to the door (20) so that additional solid particulate material can be entered into the drum (60) during the wash cycle. Solid particulate material used in the cleaning operation and returned to the sump (50) can be reintroduced into the drum (60) and can therefore be re-used in either a single wash cycle or subsequent wash cycles.

At the end of the initial cleaning stage, the drum (60) rotation speed was increased to 500 rpm (G=77) for 5 minutes to promote the exit of fluids from the drum. As the drum (60) was rotating at 500 rpm, the fluid contents of the cleaning apparatus (10) were drained (including dirty/grey water) from the sump (50) but the beads were not removed. A number of beads therefore remained in the drum following the initial cleaning stage). Fresh water (15 liters) was added to the sump (50) and a wash cycle was restarted by re-introducing beads to the drum (60) from the sump (50) with the drum rotating at a speed of 80 rpm (G=2) to commence a second cleaning stage. Additional beads from the sump (50) were introduced to the drum (60) in a series of pulses occurring every 30 seconds for 15 minutes. The drum (60) rotation speed was increased to 80 rpm (G=2) at three separate intervals during this stage of the cycle to form three independent doughnuts. Bead pulses were co-ordinated so as to direct beads into the centre of the doughnuts once they were formed. For the intervening periods where the substrates did not adopt a doughnut configuration, the drum (60) was rotated at 47 rpm (G=0.7) for several revolutions in one direction and then a similar number of rotations in the opposite direction.

Following the second cleaning stage, the drum (60) rotation speed was increased to 500 rpm (G=77) for 5 minutes. As the drum (60) was rotating at 500 rpm, the fluid contents of the cleaning apparatus were again drained from the sump (50) with the beads left inside the drum (60). A rinsing operation was then conducted by introducing 5 liters of water onto the washload in the drum (60) from the spray head (12) and rotating the drum at variable high (G>1) and low (G<1) spin speeds) for 3 minutes. The purpose of this step was to disrupt the soiled substrates as much as possible thereby ensuring all areas of the substrates were exposed to the rinse water.

In order to remove the beads following completion of the wash cycle the drum (60) was rotated in both a clockwise and an anticlockwise motion at high (G>1) and low (G<1) speeds for a period of about 5 to 10 minutes in order to release any trapped beads. The total time for the all cleaning steps as carried out in the test for the method of the invention was 73 minutes.

TABLE 1

| Cleaning Test Results | | | | | | | |
|---|---|---|---|---|---|---|---|
| | | Y Value | | | | | |
| | Bead type | Cotton | Sebum | Carbon black | Blood | Cocoa | Red Wine |
| Wash cycle with a standard domestic washing machine | none | 92.57 | 62.7 | 33.8 | 42.78 | 48.31 | 58.91 |
| Wash cycle of the invention (Ex. 1) | nylon | 91.56 | 65.25 | 38.08 | 44.84 | 51.76 | 59.28 |
| | polypropylene | 91.14 | 65.76 | 38.98 | 46.09 | 51.67 | 60.03 |

The results obtained when conducting a standard wash cycle with a typical domestic washing machine compared to those obtained when performing a wash cycle in accordance with the method of the present invention are shown in Table 1. The Y value indicates a measure of staining of the substrate. The closer the Y value is to 100, the "whiter" or cleaner the substrate. As can be seen from Table 1, the method of the invention demonstrated a significantly improved cleaning performance (i.e. higher Y values) for all five of the test substances applied to the test substrate. Consequently, the methods and apparatus of the invention exhibit a substantial overall improvement in cleaning effect when compared to known domestic cleaning processes.

Furthermore, the total volume of water used when applying the cleaning process of the invention is significantly lower than those levels associated with the use of conventional aqueous washing procedures, offering significant advantages in terms of cost and environmental benefits.

Three further cleaning tests (Examples 2, 3 and 4) were carried out in a manner generally in accordance with that of Example 1.

Thus, in Example 2, the cleaning apparatus corresponded only to the third aspect of the present invention, and the method corresponded only to the first aspect of the present invention (i.e. not the fourth and second aspects, respectively). In other words, the method comprised operating the cleaning apparatus for a wash cycle during which the drum is caused to rotate such that the soiled substrate describes an annular path whereby a central portion of the drum is not occupied by any soiled substrate for a first period, and wherein the drum is further caused to rotate such that the soiled substrate does not describe an annular path for a second period. The wash cycle lasted for 30 minutes and comprised 60 bead pulses. Each pulse lasts for 15 seconds followed by 15 seconds of tumbling. Every fifth bead pulse coincided with an annular configuration of the substrate (i.e. doughnut formation), which corresponds to 10% of the wash cycle. For formation of the annular configuration (doughnut), the drum was caused to rotate at 80 rpm (1.98 G). For the non-annular configuration (tumbling), the drum was caused to rotate at 47 rpm (0.7 G).

In Example 3, the cleaning apparatus corresponded only to the fourth aspect of the present invention, and the method corresponded only to the second aspect of the present invention (i.e. not the third and first aspects, respectively). In other words, the method comprised a first and second cleaning cycle separated by a step of draining from the cleaning apparatus the wash liquor of the first cleaning cycle. During the second cleaning cycle, the method comprised rotating the drum and introducing a multiplicity of solid particles into the drum as said drum rotates. The first cleaning cycle conformed to the conventional operation of the apparatus, i.e. without doughnut formation. The second cleaning cycle ran for 10 minutes during which beads were pulsed into the drum every 10 seconds, each pulse being separated by 10 seconds of tumbling only. There were 30 bead pulses in total. The tumbling speed was 47 rpm (0.7 G) and the tumbling changed direction every other pulse. Following the second cleaning cycle, the method continued with the extract spins and bead removal sections of the cycle, according to the conventional operation of this apparatus.

Example 4 is a comparative example, and utilised neither the first nor second aspects of the invention. In other words, the wash cycle comprised the conventional operation of the apparatus as disclosed in WO-2011/098815-A such that, instead of the bead-containing pulses, the method of Example 4 utilised standard spray rinses that covered the same period of 10 minutes.

For the avoidance of doubt, all tests were carried out using the same detergent composition in each case.

The cleaning test results for an ambient 20° C. cycle for Examples 3 and 4 are present in Table 2 below.

TABLE 2

| Cleaning tests results (Examples 3 and 4) | | | | | | |
|---|---|---|---|---|---|---|
| | Cotton | Sebum | Carbon Black | Blood | Cocoa | Red Wine |
| Ex. 3 | 89.55 | 68.8 | 40.93 | 66.17 | 60.16 | 62.53 |
| Ex. 4 (comparative) | 90.53 | 65.07 | 36.61 | 63.29 | 52.63 | 60.41 |

All scores in Table 2 are in Y colour. Y colour is an indication of whiteness. The cotton is a re-deposition swatch. It can be seen there is a drop-off across all of the cleanable stains when the second cleaning cycle bead rinse is removed (i.e. Comparative Example 4), thereby demonstrating the surprising advantage of the method and apparatus of the invention. Typically, a change of 2 Y or greater represents a significant effect and is visible to the naked eye.

Results for Example 2 also demonstrated superior performance relative to Comparative Example 4.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment, case, instance or example of the invention are to be understood to be applicable to any other aspect, embodiment, case, instance, or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

As used herein the words "the method" are preferably meant to mean "any of the methods described in the present invention", more preferably "the methods according to the first and second aspects of the present invention" unless stated to the contrary or unless the person of ordinary skill would understand such a combination not to be possible or not intended. Equally, the words "the apparatus" are preferably meant to mean "any of the apparatuses described in the present invention", more preferably "the apparatus according to the third or fourth aspects of the present invention" unless stated to the contrary or unless the person of ordinary skill would understand such a combination not to be possible or not intended.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for cleaning at least one soiled substrate in a rotatably mounted cylindrical drum of a cleaning apparatus, the method comprising:

rotating the drum such that said at least one soiled substrate describes an annular path whereby a central portion of the drum is not occupied by any soiled substrate and introducing a multiplicity of solid particles into said central portion of the drum, wherein the method comprises operating the cleaning apparatus for a wash cycle wherein during said wash cycle the drum is caused to rotate such that said at least one soiled substrate describes an annular path whereby said central portion of the drum is not occupied by any soiled substrate for a first period and wherein the drum is further caused to rotate such that said at least one soiled substrate does not describe an annular path for a second period, and wherein said drum is caused to rotate at a G force of at least 1 for said first period, and further wherein said drum is caused to rotate at a G force of less than 1 for said second period.

2. The method according to claim 1 wherein said drum is caused to rotate at a G force of between 1 and 10 for said first period such that said at least one soiled substrate describes said annular path.

3. The method according to claim 1 wherein said drum is caused to rotate at a G force of 0.7 or less than 0.7 for said second period.

4. The method according to claim 1 wherein the multiplicity of solid particles are introduced into the drum along a trajectory which, at the location of entry of the particles to the drum, is substantially parallel to the axis of the drum.

5. The method according to claim 1 wherein the method further comprises the step of moistening said at least one soiled substrate with water prior to introducing said multiplicity of solid particles into the drum.

6. The method according to claim 1 wherein the method further comprises the step of introducing at least one additional cleaning agent into the drum following the introduction of said multiplicity of solid particles.

7. The method according to claim 1 wherein the drum is mounted about a substantially horizontal axis.

8. The method according to claim 1 wherein the drum comprises a rotatably mounted cylindrical cage comprising perforated side walls wherein said perforations comprise holes having a diameter of no greater than 5.0 mm.

9. The method according to claim 1 wherein the at least one soiled substrate comprises a textile material, in particular one or more garments, linens, napery, towels or the like.

10. The method according to claim 1 wherein the multiplicity of solid particles comprises or consists of a multiplicity of polymeric particles, or wherein the multiplicity of solid particles comprises or consists of a multiplicity of non-polymeric particles.

11. The method according to claim 1 wherein the solid particles are reused one or more times for cleaning of said at least one soiled substrate.

* * * * *